US006386013B1

(12) United States Patent
Werth

(10) Patent No.: US 6,386,013 B1
(45) Date of Patent: May 14, 2002

(54) CONTAINER END WITH THIN LIP

(75) Inventor: Elmer D. Werth, Arvada, CO (US)

(73) Assignee: Container Solutions, Inc., Arvada, CO (US)

( * ) Notice: Subject to any disclaimer, the term of this patent is extended or adjusted under 35 U.S.C. 154(b) by 0 days.

(21) Appl. No.: 09/879,344

(22) Filed: Jun. 12, 2001

(51) Int. Cl.[7] ..... B21D 51/44
(52) U.S. Cl. ..... 72/348; 72/351
(58) Field of Search ..... 72/348, 350, 351, 72/379.4

(56) References Cited

U.S. PATENT DOCUMENTS 3,957,005 A * 5/1976 Heffner ..... 72/348
4,109,599 A 8/1978 Schultz
4,333,582 A 6/1982 Bloeck et al.
4,606,472 A 8/1986 Taube et al.
4,809,861 A 3/1989 Wilkinson et al.
4,832,223 A 5/1989 Kalenak et al.
5,152,421 A 10/1992 Krause
5,950,858 A 9/1999 Sergeant
6,065,634 A 5/2000 Brifcani et al.

* cited by examiner

*Primary Examiner*—Lowell A. Larson
(74) *Attorney, Agent, or Firm*—Kyle W. Rost

(57) ABSTRACT

A container end is provided with a suitable stock thickness for necessary strength and pressure resistance over its selected areas of its central portion while employing a substantially thinner peripheral wall. A method of forming thins the peripheral wall by drawing and ironing in a single workstation using compound die that also shears the blank from sheet stock. Optionally, multi-layers or laminates form the central portion of a lid, with a reduced number of layers forming the peripheral wall. Alternatively, the peripheral wall is thinned by ironing, spinning, or roll forming after the blank is formed into a shell. A forming apparatus clamps a planar peripheral wall of a blank with a clamping element that includes a thining tool. The apparatus oppositely offsets the center of the blank from the peripheral wall to draw the peripheral wall over the thinning tool on the clamping element.

9 Claims, 22 Drawing Sheets

CONTAINER END WITH THIN LIP

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Technical Field

The invention generally relates to receptacles and to the end wall structure of a container such as a metal can, bottle, or jar. More specifically, as applied to a metal can, the invention relates to the joint or seam between the sidewall and end wall of a metal can. As applied to a glass bottle, the invention relates to the side wall or skirt of a crown style bottle cap. As applied to a glass jar with threaded engagement to a lid, the invention relates to the side wall or threaded wall of a jar lid. The invention also relates to method and apparatus for forming the wall structure. The invention discloses several embodiments of a contoured lid or shell, especially a lid of variable thickness. In four specific embodiments, the invention discloses a multi-layer lid structure, a single layer lid structure with reduced thickness in the curl or peripheral lip portion, a crown style bottle cap with reduced thickness in the skirt portion, and a jar lid with reduced thickness in the shirt portion. In addition, the invention discloses apparatus and method for forming lids with a peripheral lip, curl, or skirt of reduced thickness.

2. Background Art

Metal containers are produced in two-piece and three-piece constructions. Three-piece containers are constructed from a cylindrical sidewall piece and two independent end wall pieces. The latter are applied to the respective ends of the sidewall to form a closed container. Two-piece containers are constructed from a single can body piece that includes both an integral sidewall and end wall, plus one end wall piece that is applied to the open end of the body to form a closed container. Both types of containers are produced in extremely large numbers, which creates an economic incentive to save even small amounts of metal in producing each one.

The manufacture of two-piece containers such as metallic beverage cans by the draw and iron process is widely practiced. The body of a two-piece container is efficiently produced from a single disc of sheet stock. For efficient use of metal, the thickness of the sheet stock is chosen with consideration for the maximum needed wall thickness, since most metal working processes reduce wall thickness rather than increase it. According to this known technique, sheet metal coil stock of the chosen thickness is fed into a machine called a cupper. There, the sheet is blanked into round discs of metal. After these discs are cut, the cupper processes the discs by forming them into shallow cups, which are substantially wider in diameter than the finished can body. The cup is further processed in a bodymaker machine. Here, a punch pushes each cup through a series of dies. The first die is a redraw die that reduces the diameter of the cup to the eventual diameter of the finished can body. Subsequent dies draw and iron the side walls of the can body, extending them to increased height, generally greater than the finished height of the can. At the termination of the punch's stroke, the punch engages a doming die that configures the bottom wall or closed end of the can body. The opposite, open end of the can body is quite irregular after bodymaking and, thus, the can body is further processed in a trimming machine. There, the irregular wall of the open end is trimmed off, leaving behind a can body of standard dimensions and with a finished lip at its open end. After trimming, the lip is necked-in and flanged as preparation to receive the can lid. The can body is filled with its intended contents, after which the can body is closed by applying the lid to the flanged lip and seaming the edge of the lid to the flanged lip.

Container ends or lids have been formed in a variety of cross-sectional shapes and by a variety of methods that typically share a basic scheme. Metal sheet stock of a preselected thickness, such as 0.009-inches, is placed in a shell press between shearing dies that come together to shear the edge of a blank in the resulting shape of a disc. The sheet metal stock is chosen to be as thin as possible, with consideration for needed strength to resist pressure in the assembled can. Aluminum having a thickness of 0.009-inches is approximately the thinnest stock that can be used in a can that will hold a pressurized beverage such as a soft drink or beer. The thickness of the stock is substantially the same as the thickness of the blank, and the lid formed from the blank similarly is of approximately the same thickness as the original sheet stock.

After the blank has been formed, and typically within the same cupper or shell press used to shear the blank from sheet stock, a punch having a ring configuration is applied against the blank, producing a circular lid with a countersink or groove near its periphery and with an upstanding frustoconical wall or chuckwall rising from the outer edge of the groove. Other portions of the punch apparatus in the shell press form a peripheral flange extending outwardly from the top of the chuckwall. In a further step, the peripheral flange is formed into a downwardly curled or hooked shape that is better suited to mate with the lip of a container body. The lid is applied over a flanged top edge of a container body as mentioned above, and the peripheral curled wall of the lid is seamed to the top edge of the container body to form a seal.

Various methods of strengthening a lid are known, which typically enable a small amount of metal savings by reducing the necessary thickness of the lid. The process of reworking the countersink to deepen it and sharpen its curvature was found to increase the strength of the lid. Such reworking might draw the metal of the lid and thus thin it. U.S. Pat. No. 4,109,599 to Schultz taught that such drawing was undesirable and would reduce the pressure resistant capabilities of the lid. Thus, Schultz developed a method of reworking the countersink without drawing the metal. In fact, Schultz was able to slightly increase the thickness of metal in the countersink groove.

As shown by the following example patents, additional technologies have followed this approach of reworking the countersink or nearby structures to strengthen the lid. U.S. Pat. No. 4,606,472 to Taube et al. provides another method for reworking the countersink groove to increase metal thickness to form a strengthened lid and countersink. U.S. Pat. No. 6,065,634 to Brifcani et al. shows a lid configured in the traditional form with center panel, surrounding countersink wall, and chuck wall. The chuck wall is reworked for greater pressure resistance by extending it at a specified inclination that improves the closeness of the side wall to the lip of the container body. U.S. Pat. No. 5,950,858 to Sergeant strengthens the lid by forming an upward fold either surrounding the central panel or at the bottom of the depending countersink wall. U.S. Pat. No. 4,832,223 to Kalenak et al. teaches the use of coining to form a frustoconical surface at the junction of the central lid panel and the countersink wall for increasing strength of the lid. U.S. Pat. No. 4,809,861 to Wilkinson et al. strengthens the countersink wall by employing curves of several different radii. U.S. Pat. No. 4,333,582 to Bloeck et al. adds a stiffening groove that surrounds a pour outlet of a lid. This added groove allows the lid material to be thinner. The various modifications to the lid made in these patents appear to have helped save metal.

An asymmetric thinning technique is used in U.S. Pat. No. 5,152,421 to Krause. A blank is thinned by rolling portions of the blank to leave only a diametric central spine or belt of the original thickness to support a pull ring opener. Such asymmetric processing may produce irregularly shaped lids that would be difficult to apply and seal with standard equipment.

It would be desirable to reduce the thickness of the metal or other material of construction in a lid at selected locations where material thickness is not critical to the strength and pressure resistance of the lid. By such a selective thickness reduction, the technologies mentioned above could be applied as a supplemental means of strengthening the lid, particularly in regions of the lid where such thinning is not done. Thus, known technologies for strengthening the countersink, configuring the chuck wall, or forming strengthening structures on the central panel could remain useful.

Additionally, it would be desirable to employ an exceptionally thin sheet stock in the shell press in order to produce lids having such thin gauge at substantially any desired area. However, exceptionally thin stock, such as stock below about 0.009-inches, has been found to lack the needed strength to resist deforming when the can must contain a pressurized liquid. Deformation in the lid can produce a leaking can, leading to a spoiled product. Consequently, in order to successfully use exceptionally thin sheet stock, such as sheet stock below about 0.009-inches, it would be desirable to supplement the thin stock with an additional layer of reinforcing stock, placed only in those areas critical to maintaining strength in the lid and resisting reversal.

Metal containers such as beverage cans and lids are formed at sequentially arranged work stations, often by a series of machines arranged to form a "can line." Each of the various machines in the can line performs one or more forming steps. At the conclusion of each station's function, the workpiece is conveyed to the next work station, which perhaps is located in the next sequentially arranged machine, until forming is complete. The space available for the can line is limited in any factory. Saving space is important. Therefore, it is desirable to perform multiple forming steps within a single machine and at each single work station. Particularly when a new forming step is introduced, it is desirable to perform the new step within the physical spaced allocated to the prior type of forming equipment. This enables a factory to incorporate the new step into the can line with only limited modifications to the can line, such as by changing the tooling within a single machine or substituting one machine for another. For thinning the lip of a container lid, it would be desirable to create both apparatus and method that can be performed within a single machine and preferably at a single work station.

To achieve the foregoing and other objects and in accordance with the purpose of the present invention, as embodied and broadly described herein, the improved lid and method of this invention may comprise the following.

BRIEF SUMMARY OF THE INVENTION

Against the described background, it is therefore a general object of the invention to provide an improved container end in which material savings are achieved by annular, concentric thinning of the peripheral lip, curl wall, or skirt.

Another general object of the invention is to provide a method and apparatus for forming a container end having an annular, concentric, thinned peripheral lip, curl wall, or skirt.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to a first aspect of the invention, a container lid is formed by a method that produces a thinned peripheral lip. First, according to a blanking step, a blank is sheared from planar sheet stock of generally predetermined stock thickness. The blank is composed of at least a central portion and a peripheral annular lip portion circumferentially bounding the central portion and lying generally in a plane. Second, according to a clamping step, the peripheral annular lip portion is clamped between first and second clamping elements, one against each face of the blank. At least the first clamping element carries a thinning tool for thinning a peripheral lip of the blank. Third, according to an ironing step, the central portion of the blank is displaced from the plane of the peripheral lip portion while applying through the clamping elements a predetermined clamping force of a magnitude allowing movement between the peripheral lip portion and the thinning tool, with resultant thinning of the lip portion to less than the generally predetermined stock thickness.

Optionally, the method may include an additional step, after the second step and before the third step, in which a transverse wall is formed by applying a center forming die against one side of the central portion of the blank. Thereafter, the third step is performed by moving the first and second clamping elements in unison to push the central portion of the blank against the center forming die, deforming the blank at the outer margin of the central portion to form an annular wall, which extends transversely to the central portion.

Optionally, the method may employ a center forming die that is configured with a central cavity bounded by a peripheral shoulder that first contacts the central portion of the blank in the transverse wall forming step. Then, according to a fourth step, a countersink element that is sized to fit into the central cavity of the center forming die is applied against the central portion of the blank on the side opposite from the center forming die.

Optionally, according to a fifth step, a central wall is formed by forming the blank over the peripheral shoulder of the center forming die by moving the countersink element further toward the central cavity, while simultaneously performing a further thinning step by further drawing the peripheral lip over the thinning tool and simultaneously forming an annular groove into the blank at a location spaced from the sheared edge of the blank. These steps define a container lid having a disc-shaped planar central wall circumferentially bounded by a concentric annular groove, in turn circumferentially bounded by a concentric annular wall positioned transversely to said planar central wall.

Optionally, a releasing step is performed by separating the first and second clamping elements.

Optionally, a stripping step is performed by moving one of the clamping elements to push the container lid free of the center forming die.

According to another aspect of the invention, an improved container end has a disc shaped central wall, circumferentially bounded by a concentric annular groove, in turn circumferentially bounded by a concentric annular frustoconical wall, in turn circumferentially bounded by a concentric annular peripheral wall. The improvement provides a central wall and countersink groove configured with a thickness greater than a predefined minimum dimension; and the peripheral wall is configured with a thickness less than the predefined minimum dimension.

In an optional aspect, the frustoconical wall is configured with a thickness greater than the predefined minimum dimension at least over an annular portion immediately juxtaposed to the groove. In another optional aspect, the frustoconical wall is configured to have a thickness less than 60% of the predefined minimum dimension at least over an annular portion immediately juxtaposed to the curl wall. In a further optional aspect, the curl wall is configured with a thickness no greater than about 56% of the predefined minimum dimension.

One method of achieving these reductions in material thickness is the use of a central wall composed of a laminate formed of at least two sheets of forming material; and the curl wall is formed of at least one less sheet of forming material than the laminate of the central wall. More specifically, the central wall may be formed of first and second sheets of forming material; while the curl wall is formed of a peripheral portion of only the first sheet of forming material. Each sheet of the laminate material may be of a thickness less than the predetermined minimum thickness. The central wall, annular groove, and frustoconical wall each may be composed of a laminate formed of at least first and second sheets of forming material, in which the first sheet has a minimum thickness of less than 60% the thickness of the laminate; and the curl wall may be formed of a peripheral portion of the first sheet of forming material. The first and second sheets of forming material each may be formed of a metal, such as aluminum or steel.

According to another aspect of the invention, a container end is formed by a method in which, first, a disc-shaped blank is sheared from planar sheet stock of a predetermined stock thickness. Second, an annular groove is formed into the blank at a location spaced from the sheared edge of the blank, defining container end having a disc-shaped planar central wall that is circumferentially bounded by a concentric annular groove. In turn, the groove is circumferentially bounded by a concentric annular wall that is positioned transversely to the planar central wall. Third, the center portion of the container end is positioned on a supporting tool, and the annular wall is engaged with a thinning tool. Fourth, the thinning tool interacts with the annular wall for thinning the annular wall to a thickness less than the predetermined stock thickness.

Optionally, the fourth step may be performed by carrying the container end on a forming mandrel for longitudinal movement through at least one ironing die, thinning the annular wall to form a container end with an annular wall thickness less than the predetermined stock thickness. In another option, the fourth step may be performed by carrying the container end on the forming mandrel sequentially through two ironing dies. In a detailed aspect, the fourth step may be performed by reducing the thickness of the annular wall by more than 40% of the predetermined stock thickness. In a further option, the fourth step may be performed by spinning the forming mandrel with the container end carried on it, and applying a forming roll against the annular wall to thin the annular wall forming a container end with an annular wall thickness less than the predetermined stock thickness. Optionally, the fourth step is performed by moving the center of the container end with respect to the thinning tool, applying the thinning tool to thin the annular wall.

Another aspect of the invention provides an apparatus for forming a container lid with a thinned peripheral lip portion from a disc-shaped blank of preselected diameter, having a central portion and an annular, generally planar, peripheral lip portion, formed of a generally predetermined stock thickness. The apparatus is formed of a pair of opposed first and second annular clamping elements that are sized to engage the blank at the annular peripheral lip portion. A thinning means is carried by at least the first of the clamping elements for thining the peripheral lip portion of the blank by relative movement between the thinning means and the peripheral lip portion. A force selection device applies a preselected clamping force between the clamping elements in a degree permitting the peripheral lip portion to be drawn between the clamping elements in response to opposite relative movement between the central portion of the blank and the peripheral lip portion, transverse to the plane of the peripheral lip portion. A displacing device oppositely relatively moves the central portion of the blank and the peripheral lip portion, transversely to the plane of the peripheral lip portion, thinning the peripheral lip portion by relative movement between the thinning means and the peripheral lip portion.

The accompanying drawings, which are incorporated in and form a part of the specification illustrate preferred embodiments of the present invention, and together with the description, serve to explain the principles of the invention. In the drawings:

Figure 6:
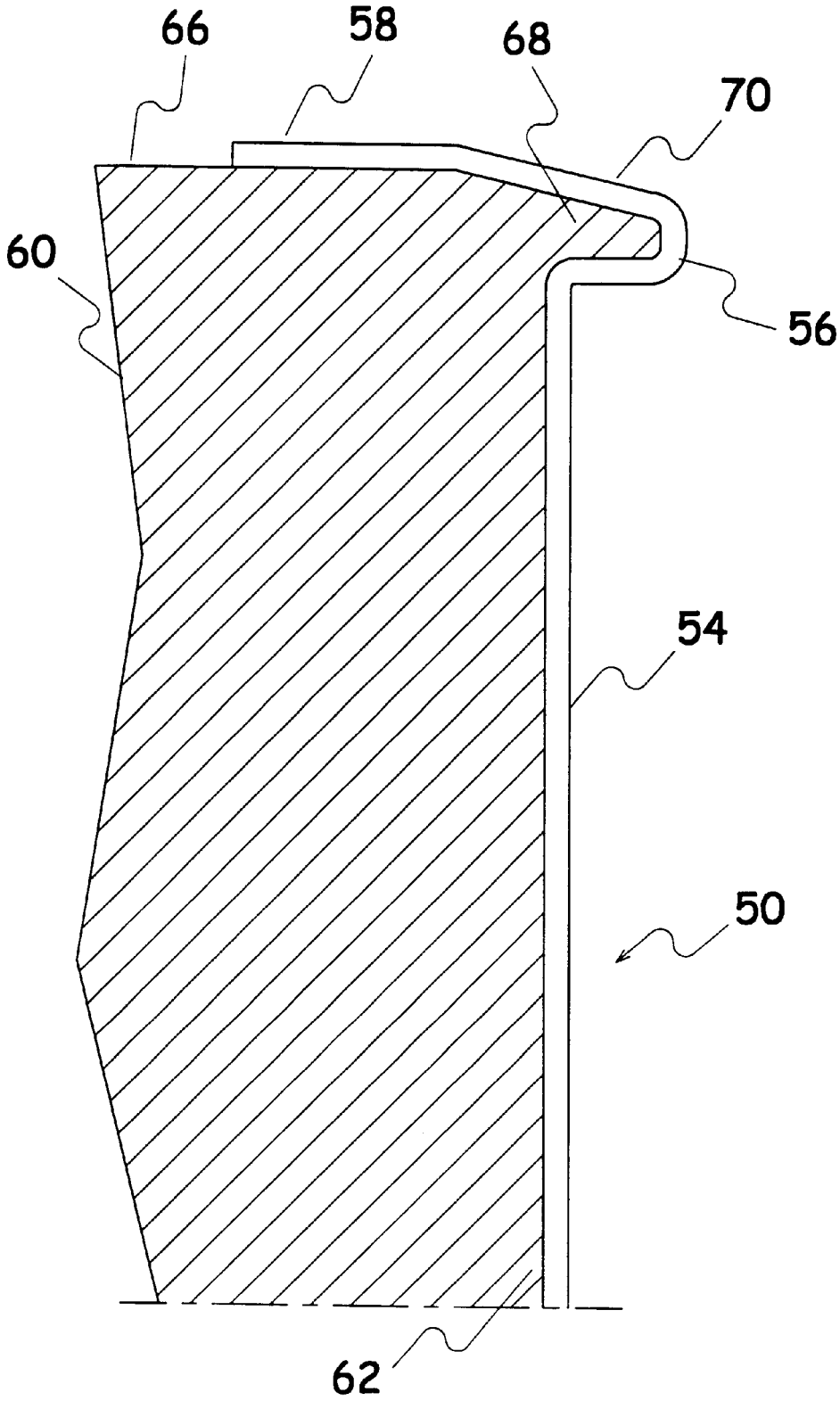
FIG. 6 is a view similar to FIG. 5, showing the container end supported on a forming mandrel.

FIG . 7 is a view similar to FIG. 6, showing the container end supported on the forming mandrel and being moved through a 1st ironing die.

Figure 7:
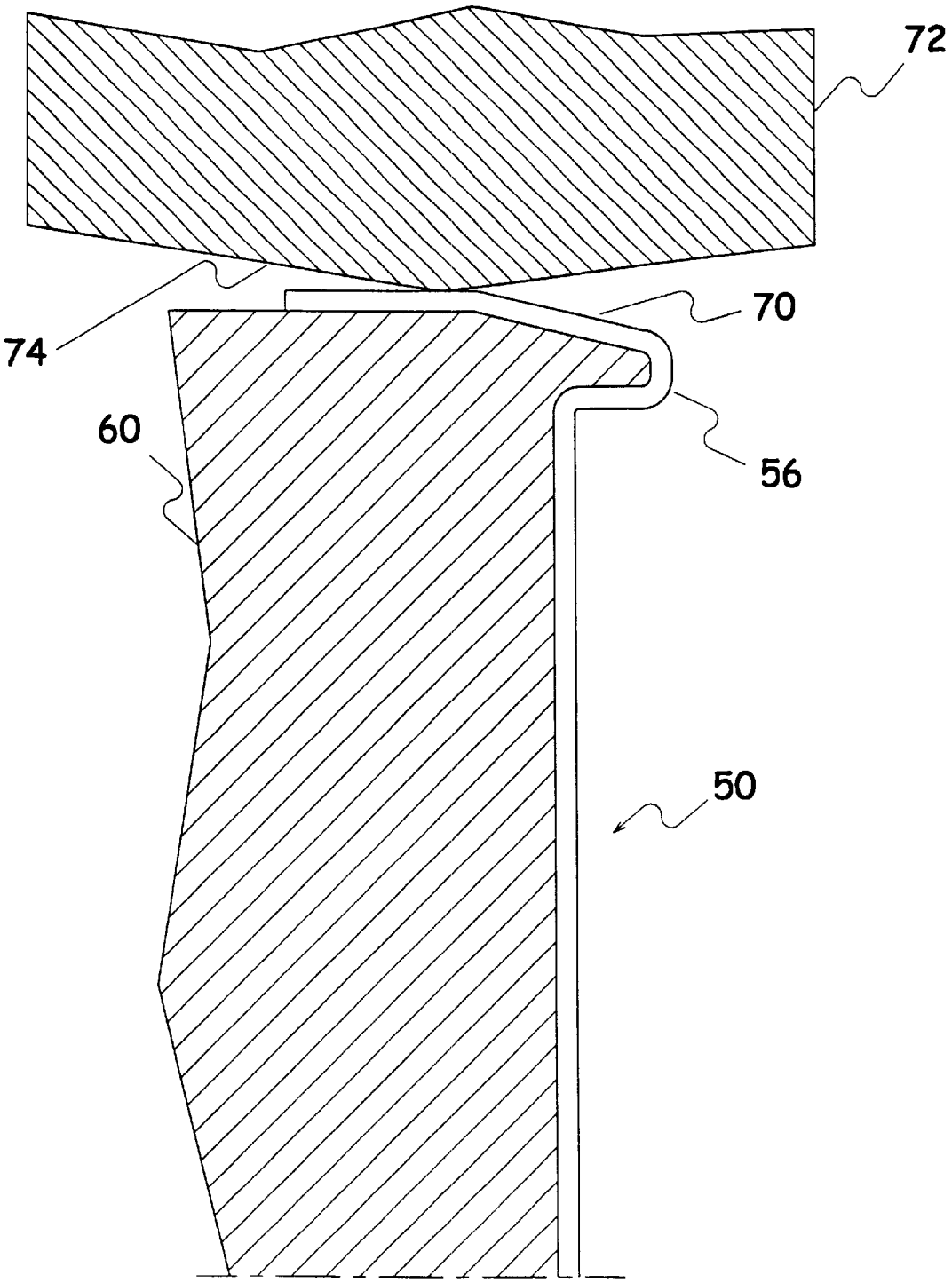
Figure 8:
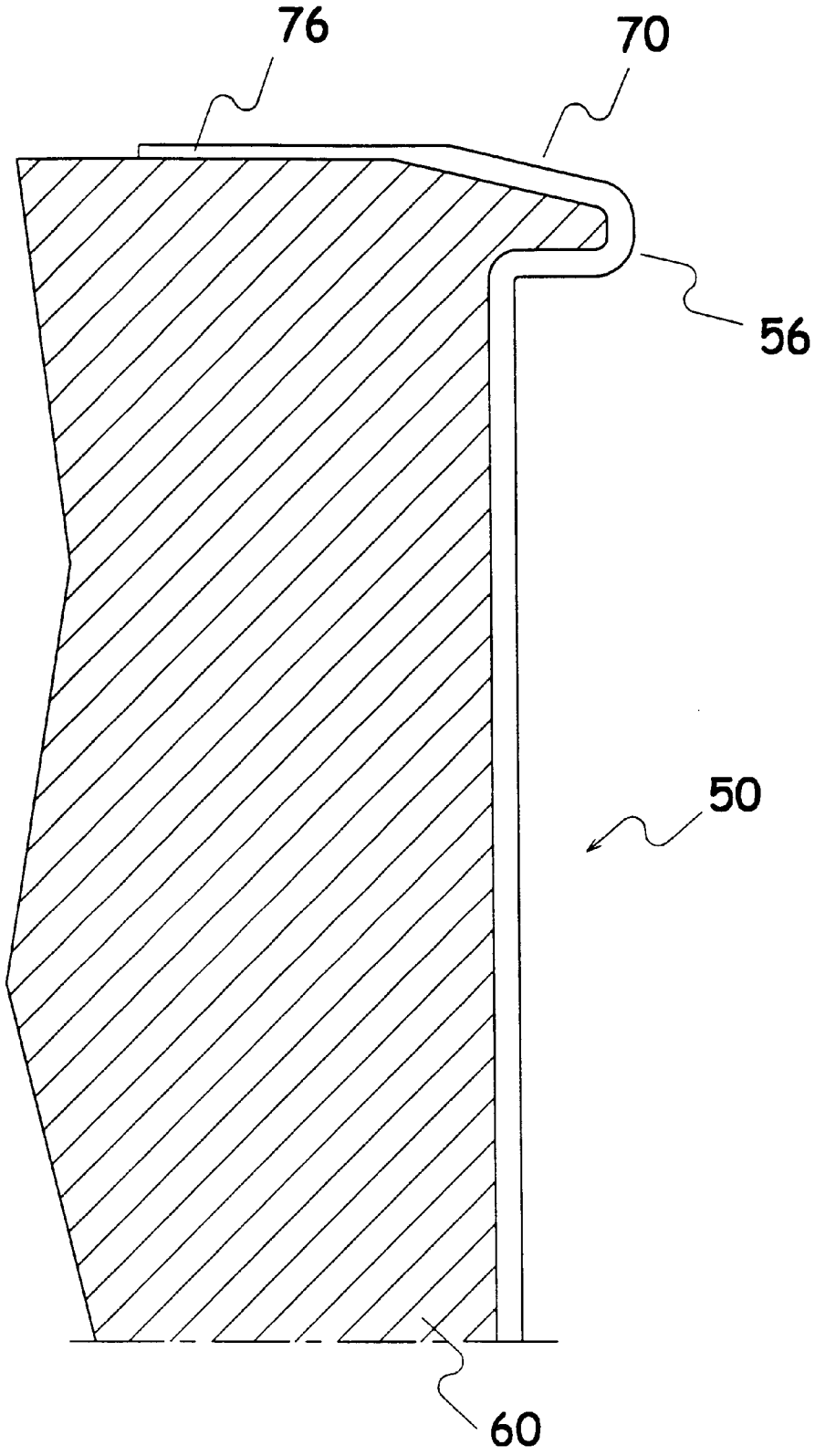

FIG. 8 is a view similar to FIG. 7, showing the container end on a forming mandrel after processing through the 1st ironing die.

Figure 9:
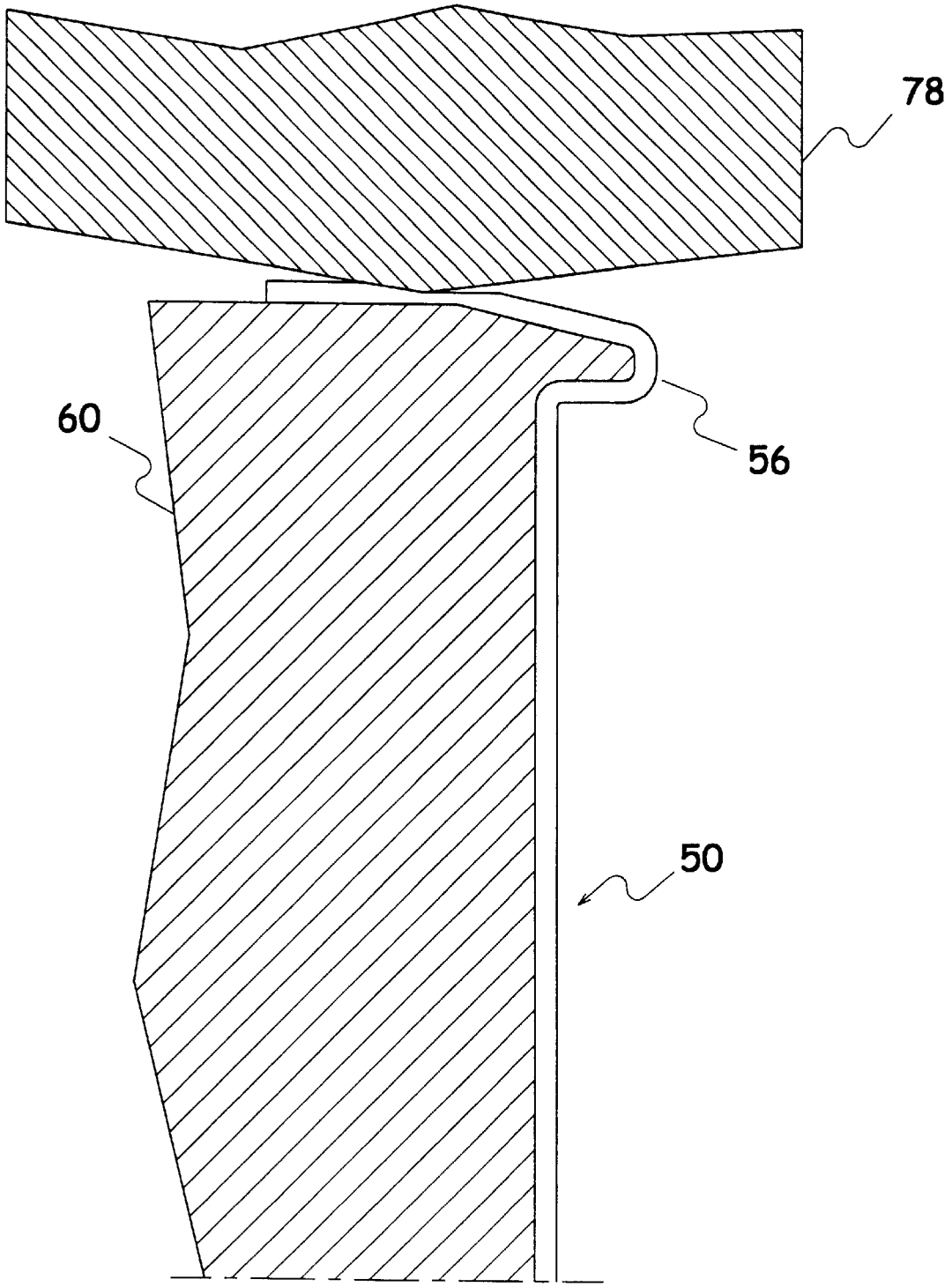

FIG. 9 is a view similar to FIG. 8, showing the container end on a forming mandrel being moved through a 2nd ironing die.

Figure 10:
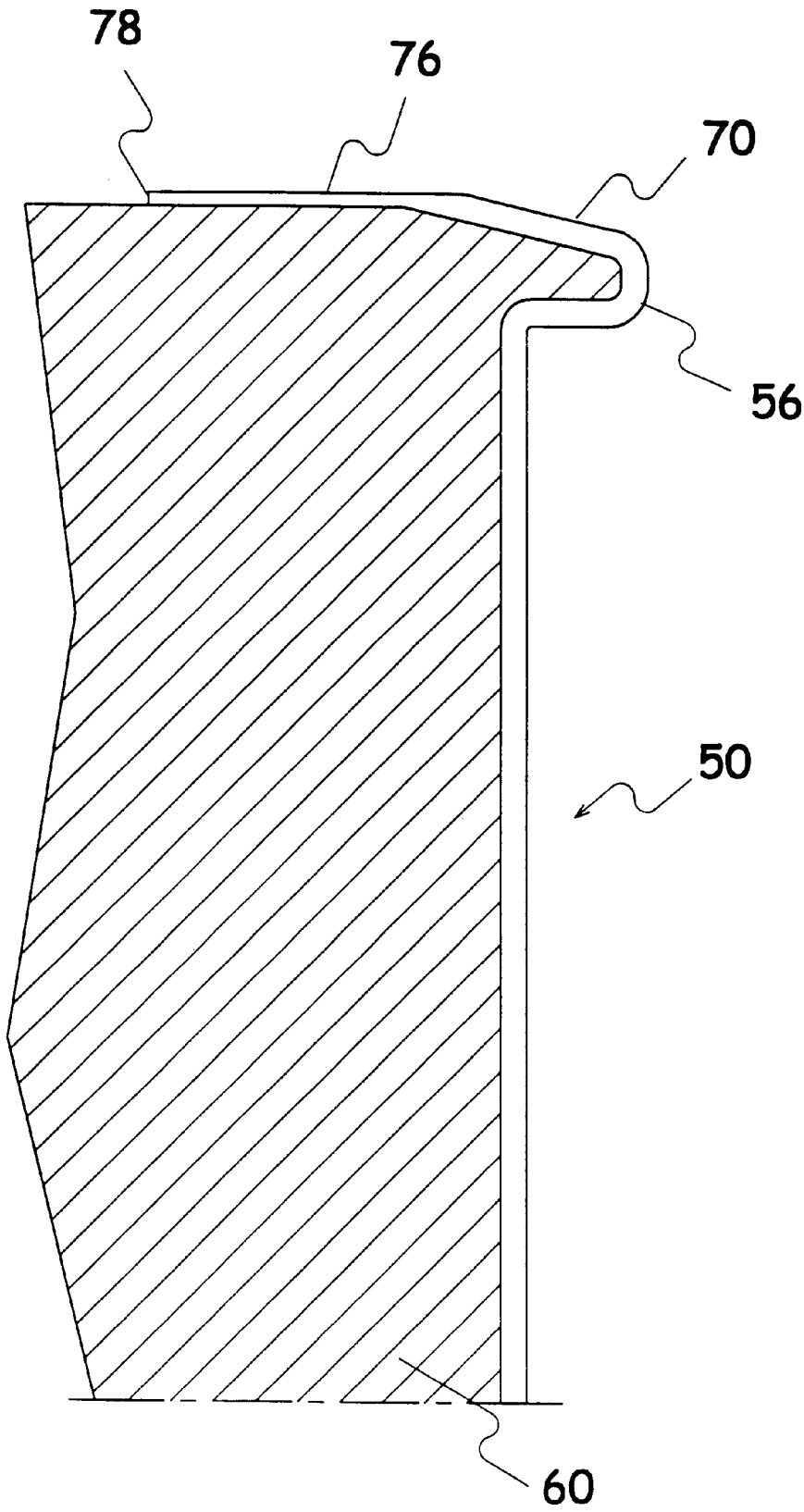

FIG. 10 is a view similar to FIG. 9, showing the container end on a forming mandrel after processing through the 2nd ironing die.

Figure 11:
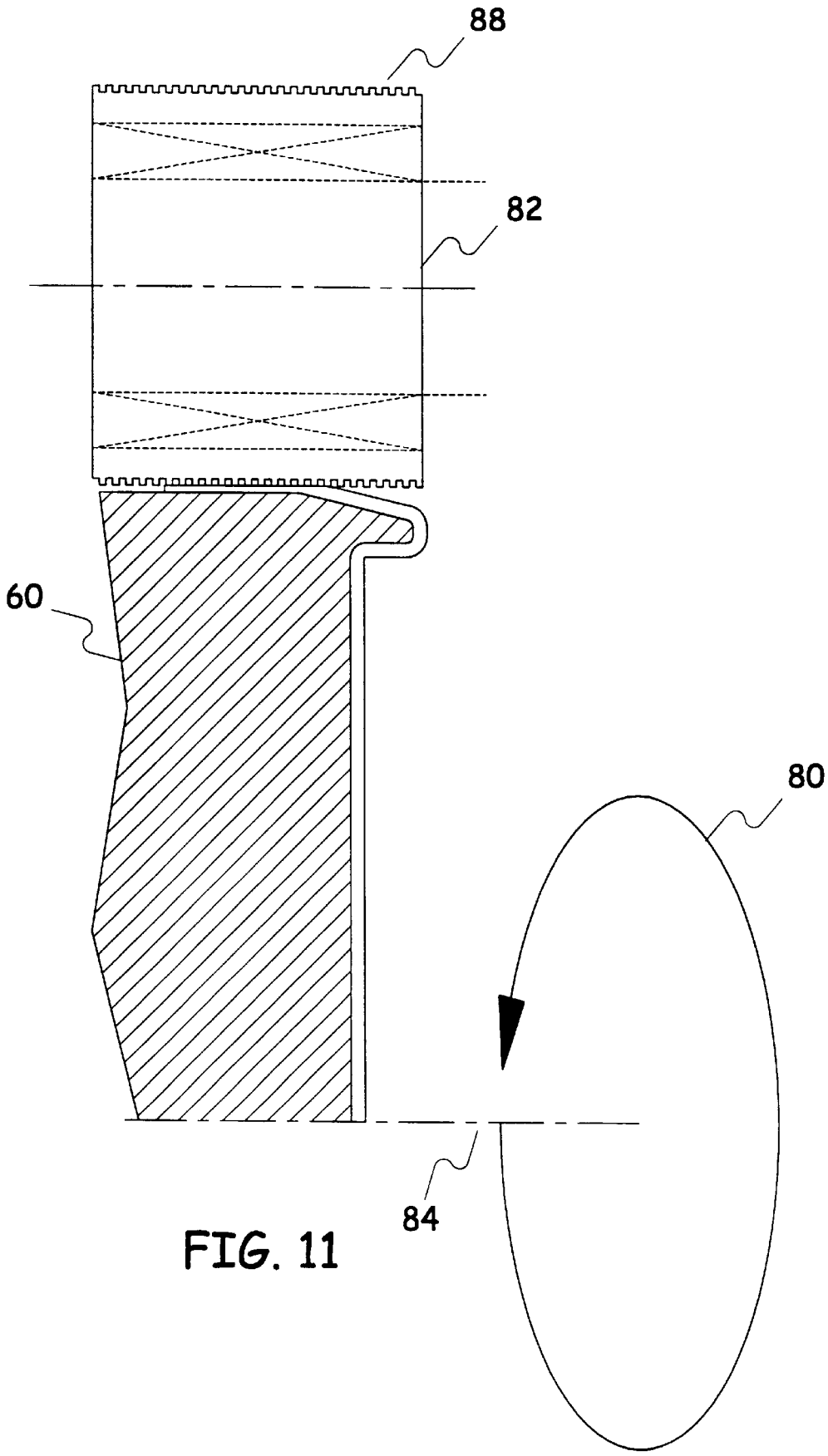

FIG. 11 is a view similar to FIG. 9, showing the container end on a forming mandrel and showing a roll forming tool processing a peripheral wall.

Figure 12:
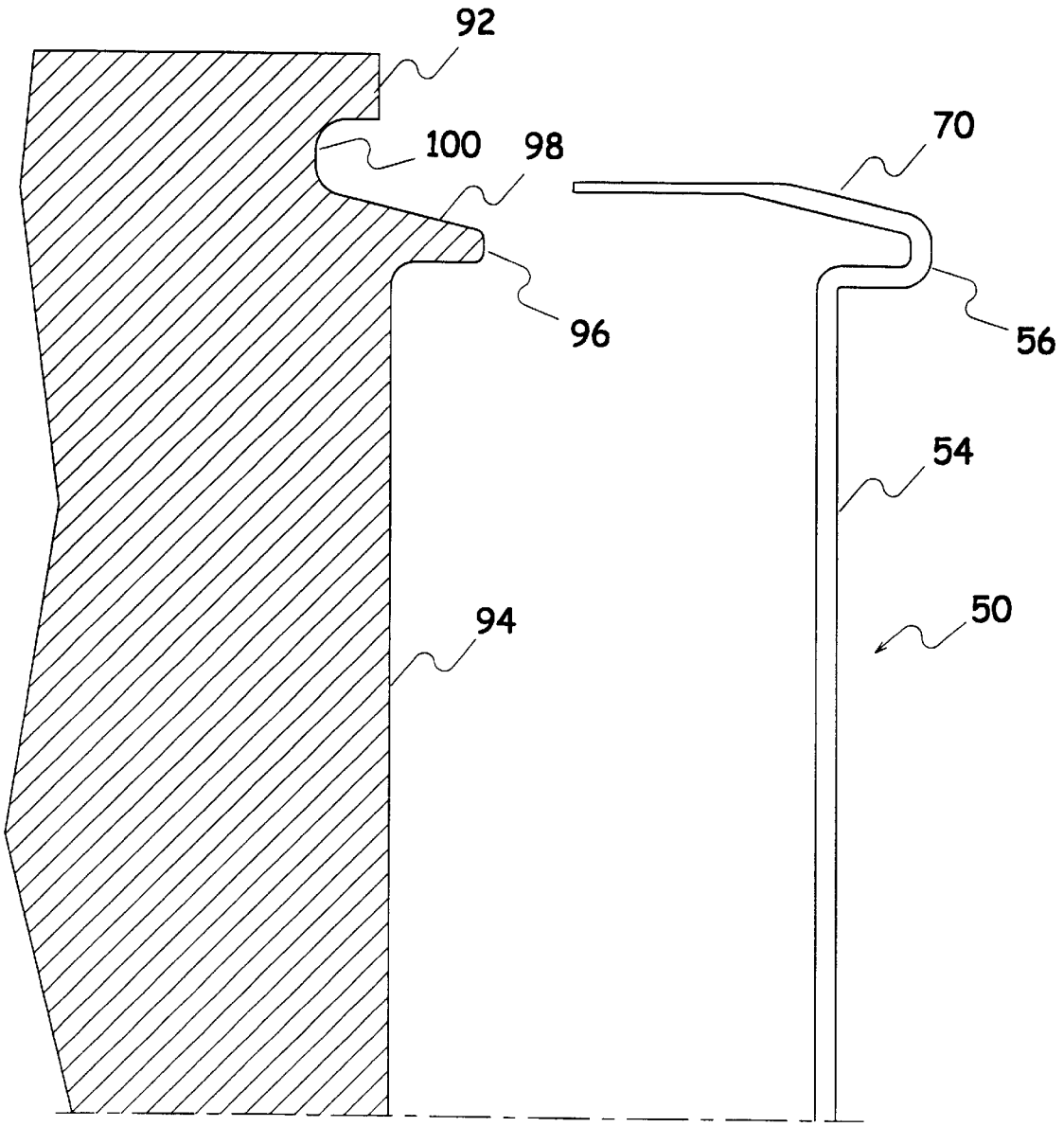

FIG. 12 is a view similar to FIG. 10, showing the container end approaching a curl forming tool.

Figure 13:
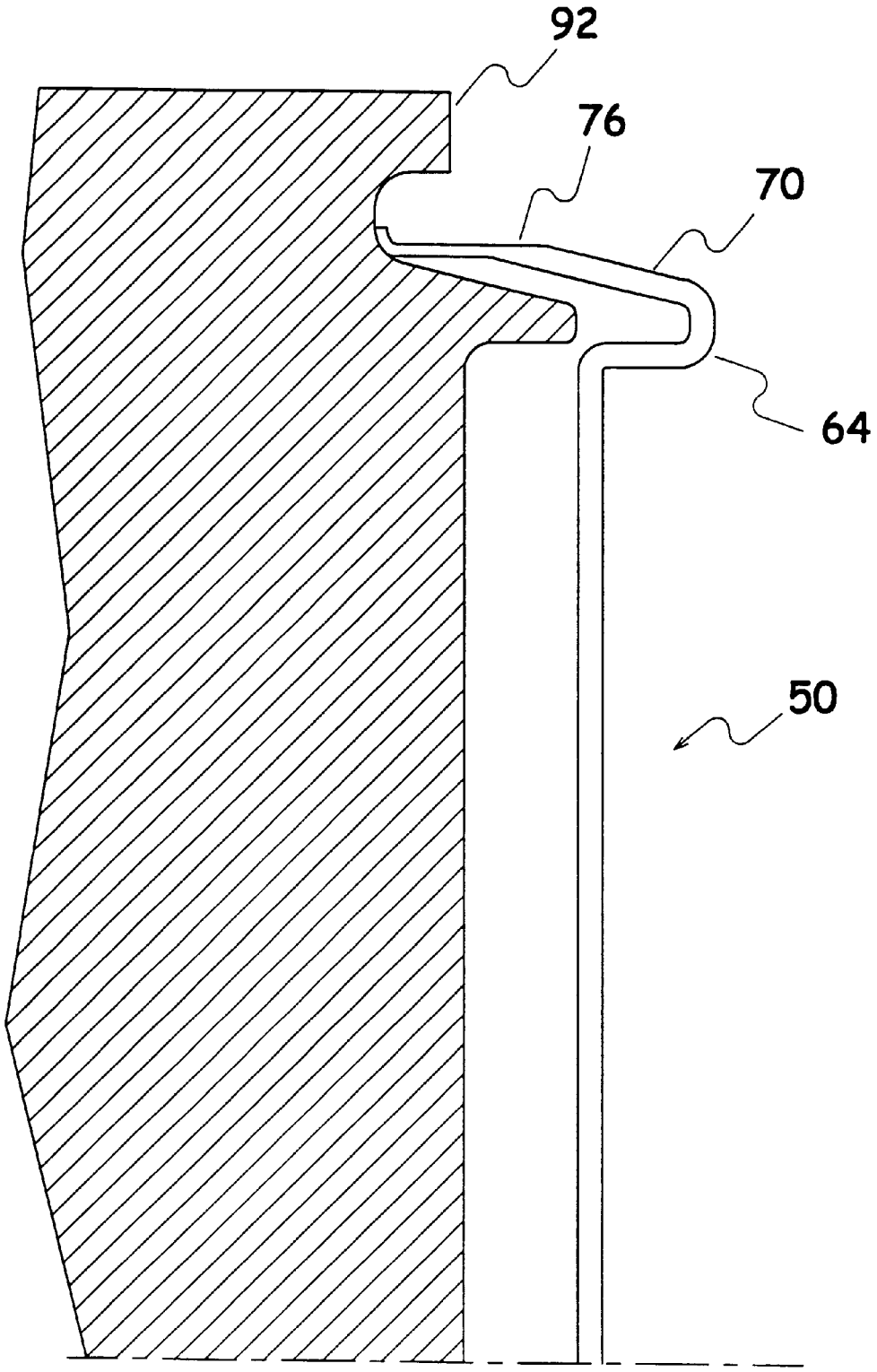

FIG. 13 is a view similar to FIG. 11, showing the curl forming tool starting to reform a peripheral wall.

Figure 14:
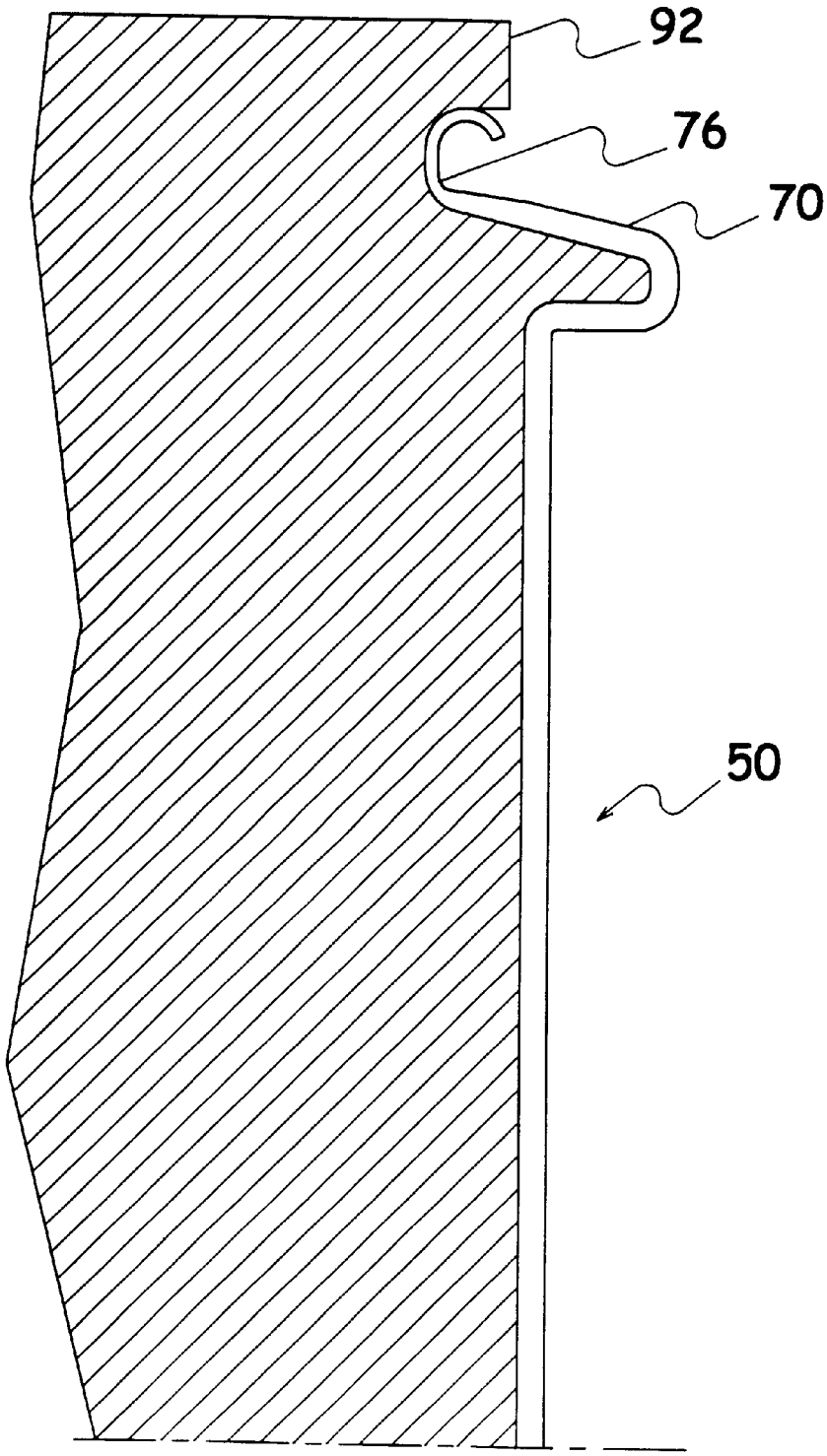

FIG. 14 is a view similar to FIG. 13, showing the container end and curl forming tool after the completed curl forming operation.

Figure 15:
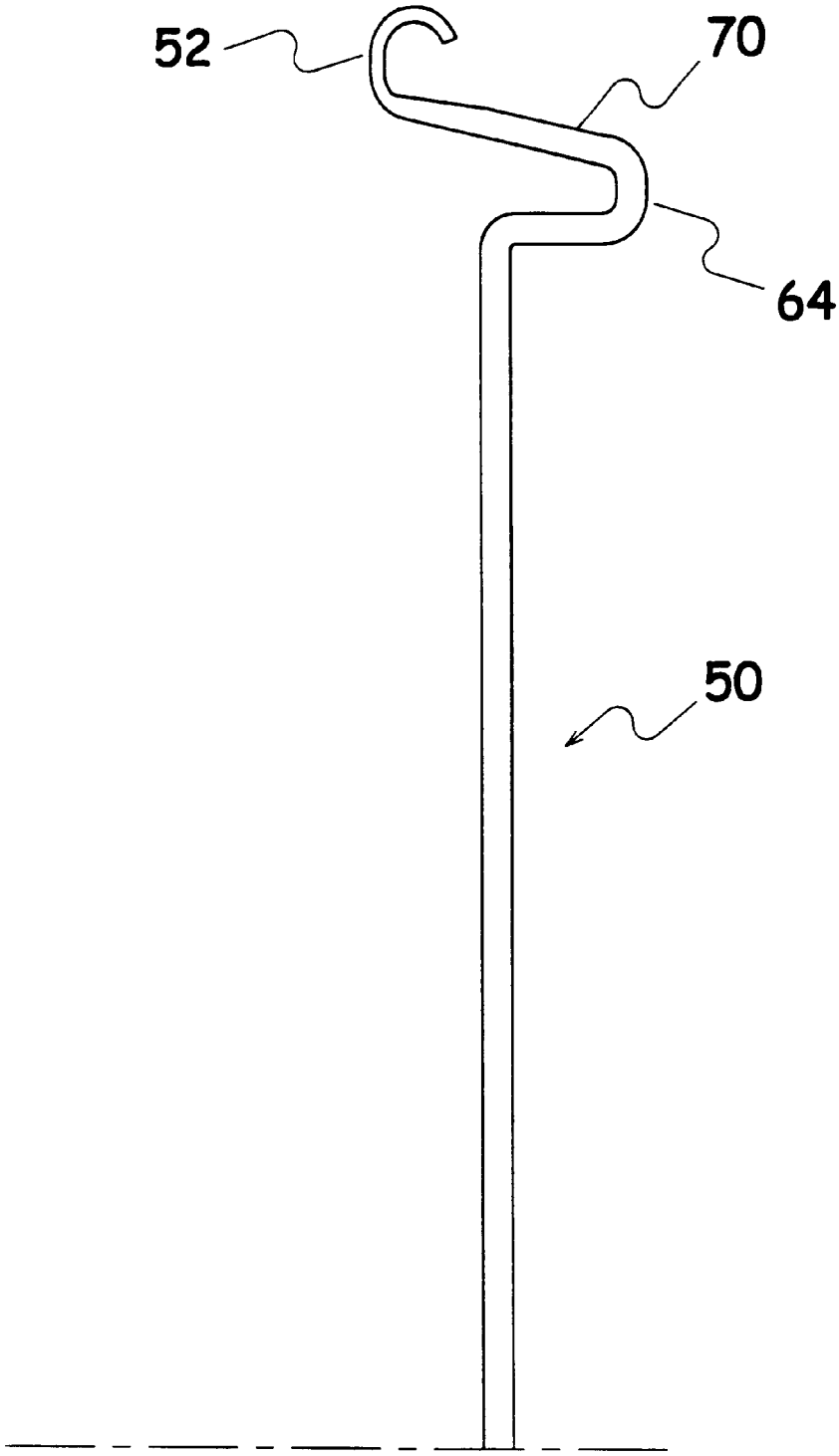

FIG. 15 is a view similar to FIG. 14, showing the container end with the peripheral wall configured into a hook shape.

Figure 16:
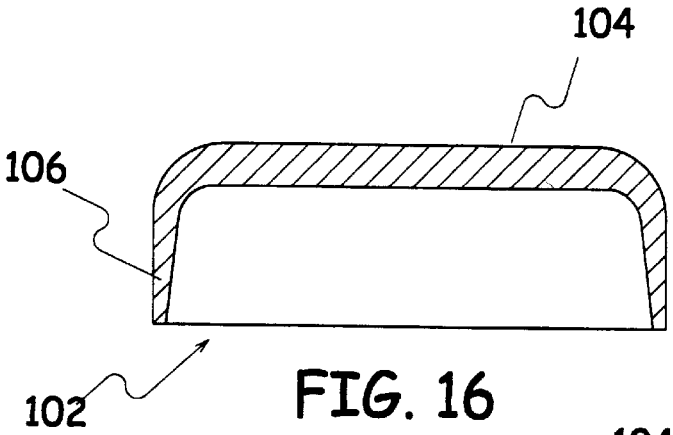

FIG. 16 is a vertical cross-sectional view of a blanked and cupped shell for forming a crown cap for a bottle.

Figure 17:
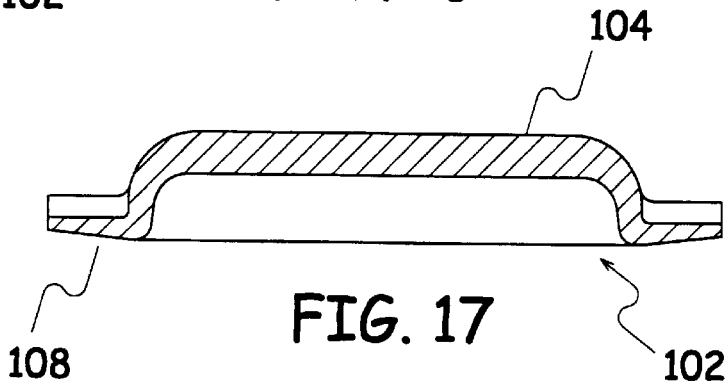

FIG. 17 is a view similar to FIG. 16, showing a shell for a crown cap with a side wall formed into a radially extending convoluted wall.

Figure 18:
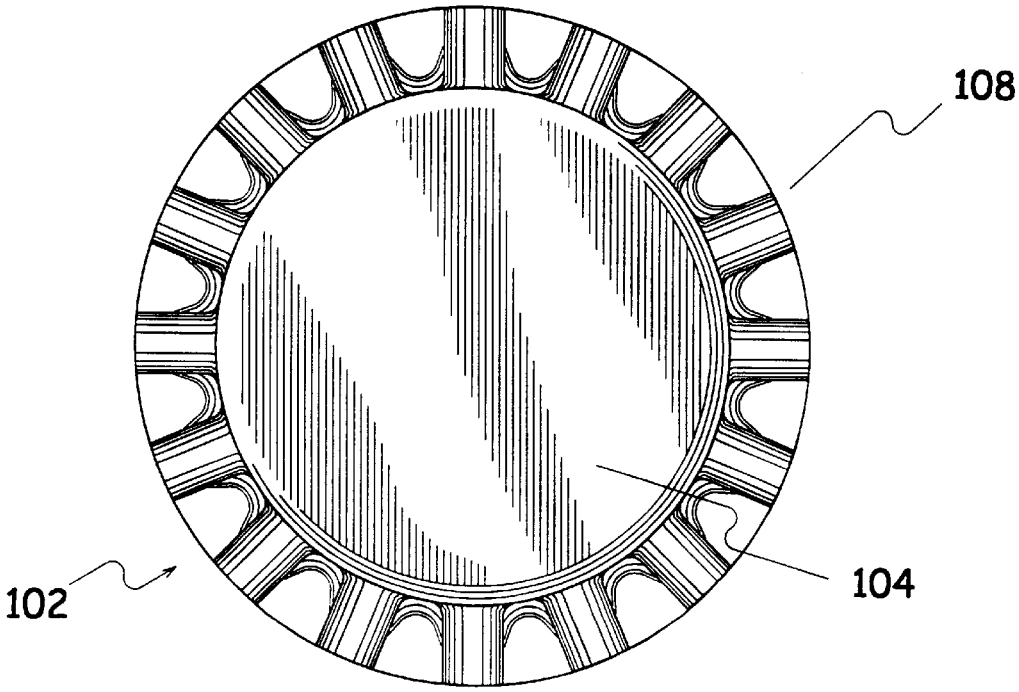

FIG. 18 is a top plan view of the crown cap shell of FIG. 17.

Figure 19:
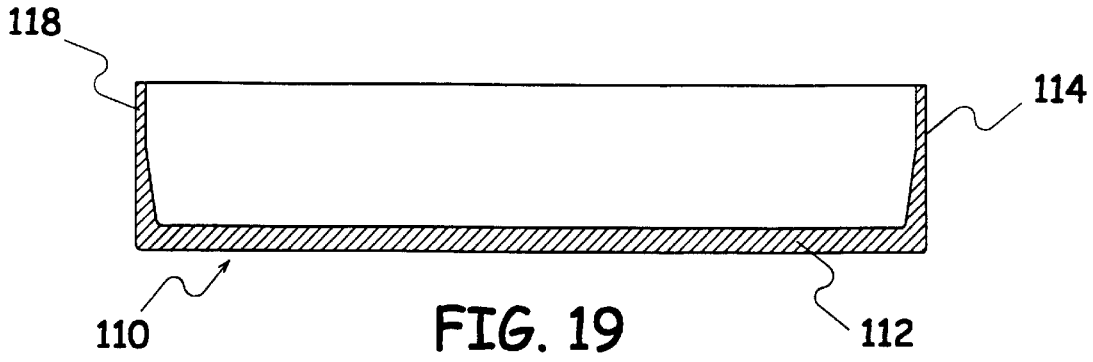

FIG. 19 is a vertical cross-sectional view of a blanked and cupped shell for forming a lid with screw-on thread followers.

Figure 20:
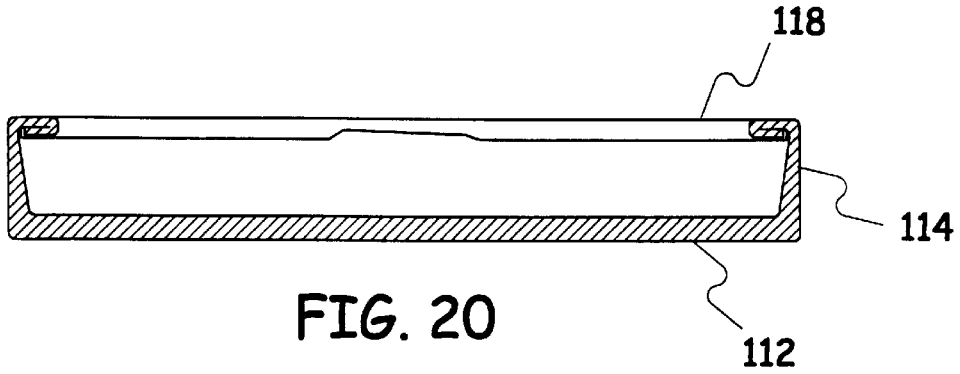

FIG. 20 is a view similar to FIG. 19, showing a shell for a threaded lid with a side wall formed for engaging threads.

Figure 21:
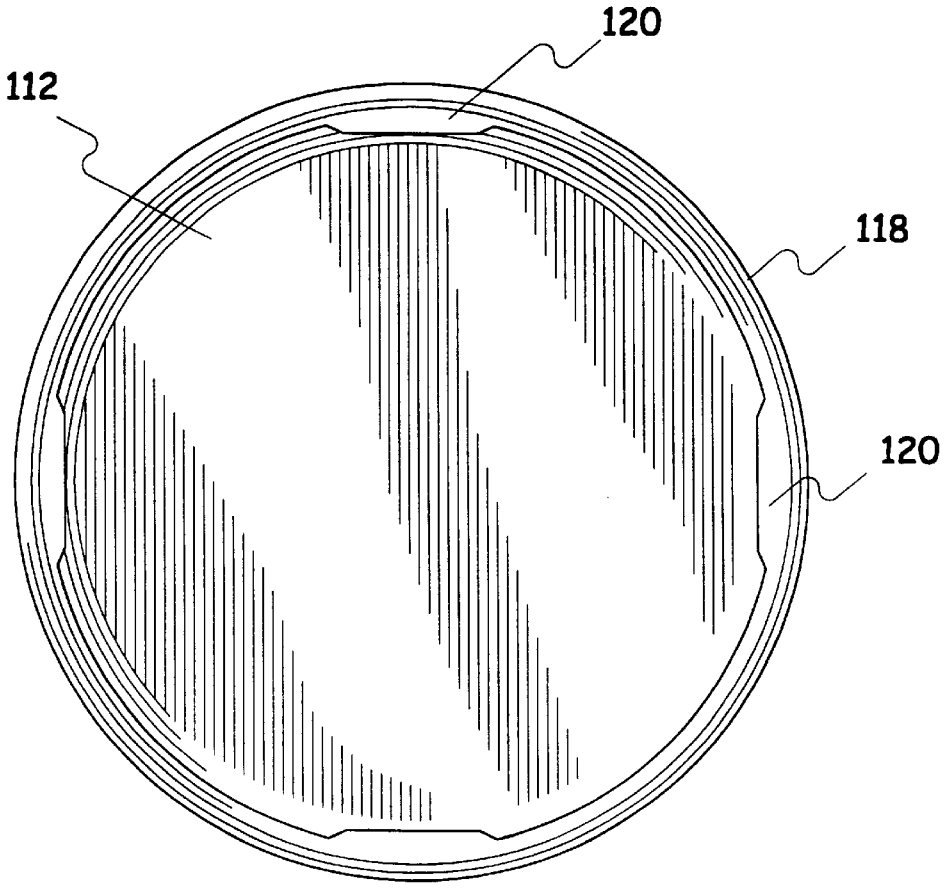

FIG. 21 is a top plan view of the lid of FIG. 20.

Figure 22:
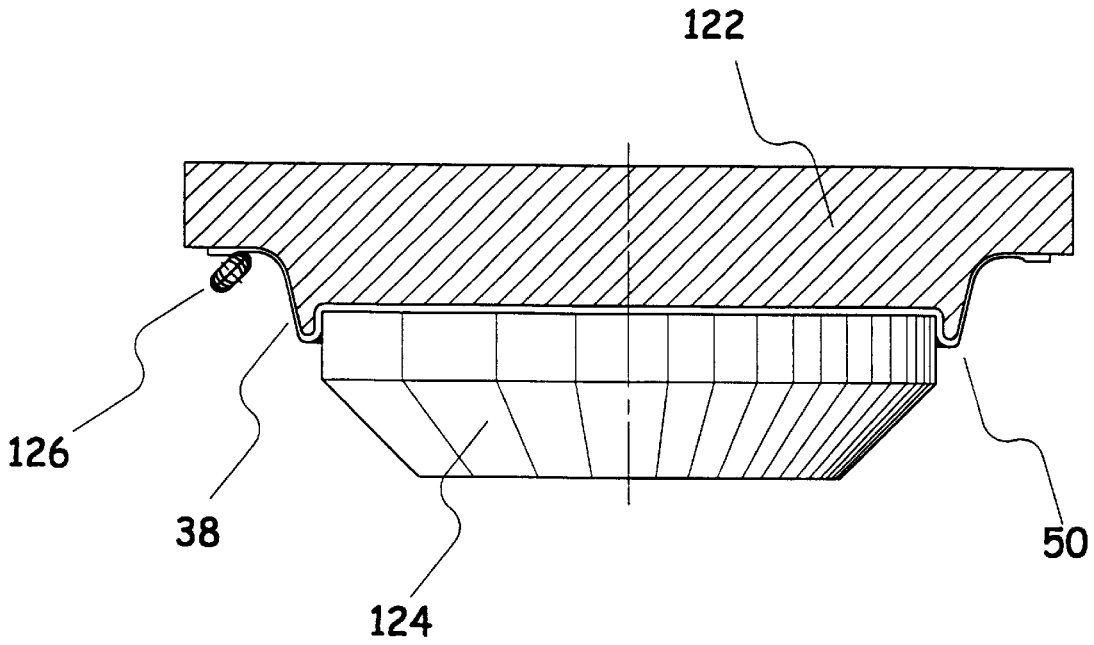

FIG. 22 is a partial vertical cross-sectional view of a lid being formed by rolling or spinning, held against a forming die by a pressure plate.

Figure 23:
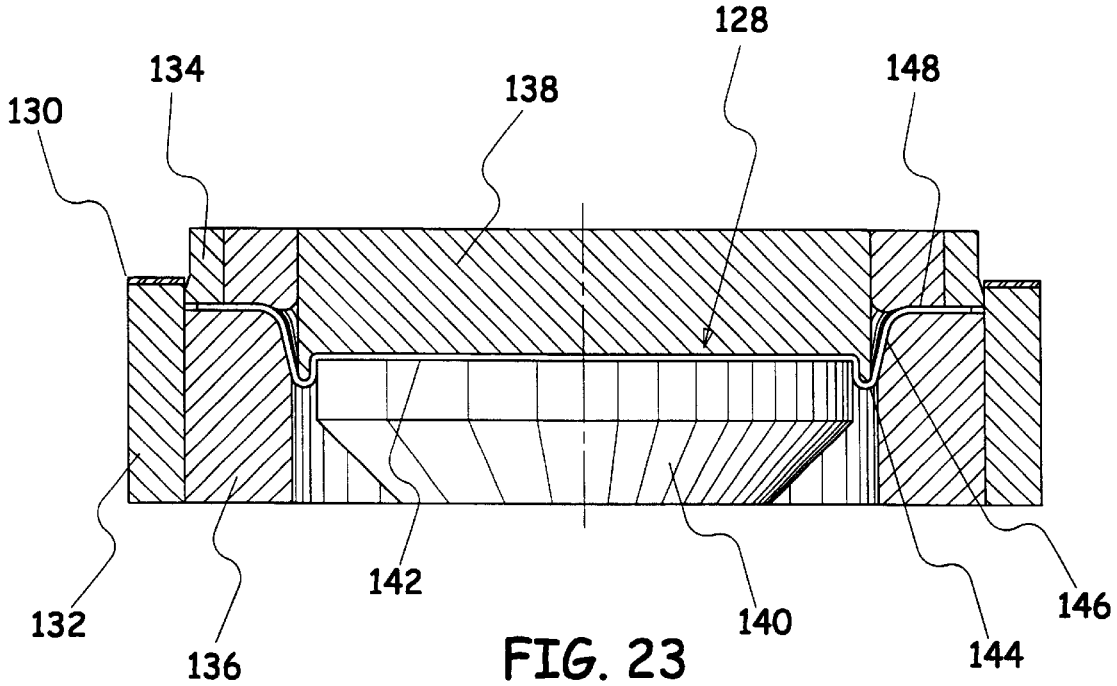

FIG. 23 is a partial vertical cross-sectional view of a lid being cut and formed by a blanking punch, held in forming dies by a pressure plate.

Figure 24:
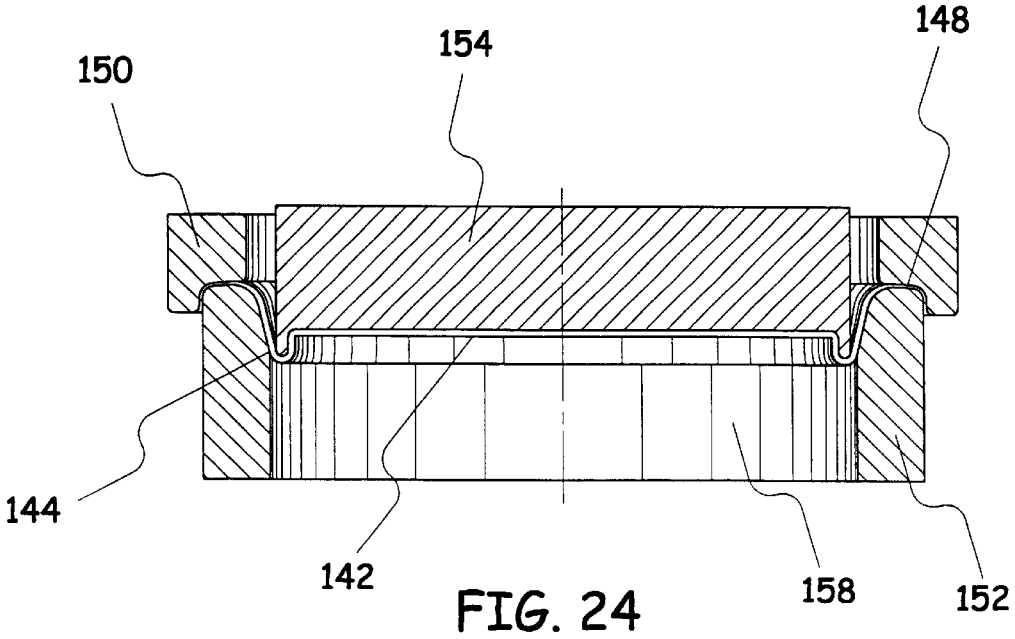

FIG. 24 is a partial vertical cross-sectional view of a blanked and formed lid having its lip thinned by coining, held in forming dies by a pressure plate.

Figure 25:
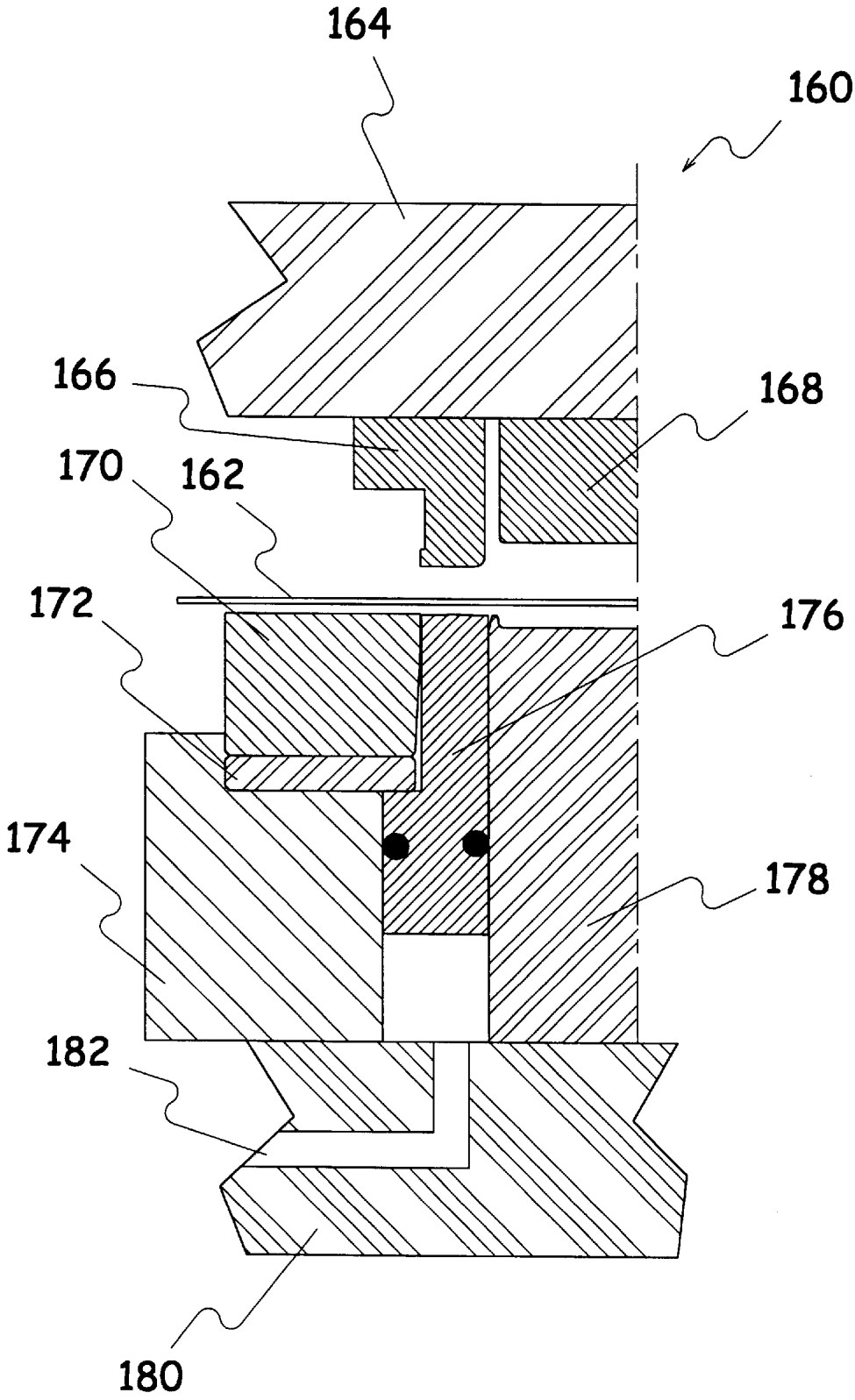

FIG. 25 is a left-half, vertical cross-sectional view of tooling in a blanking punch, prior to cutting a lid disc from sheet stock The right-half is a mirror image thereof.

Figure 26:
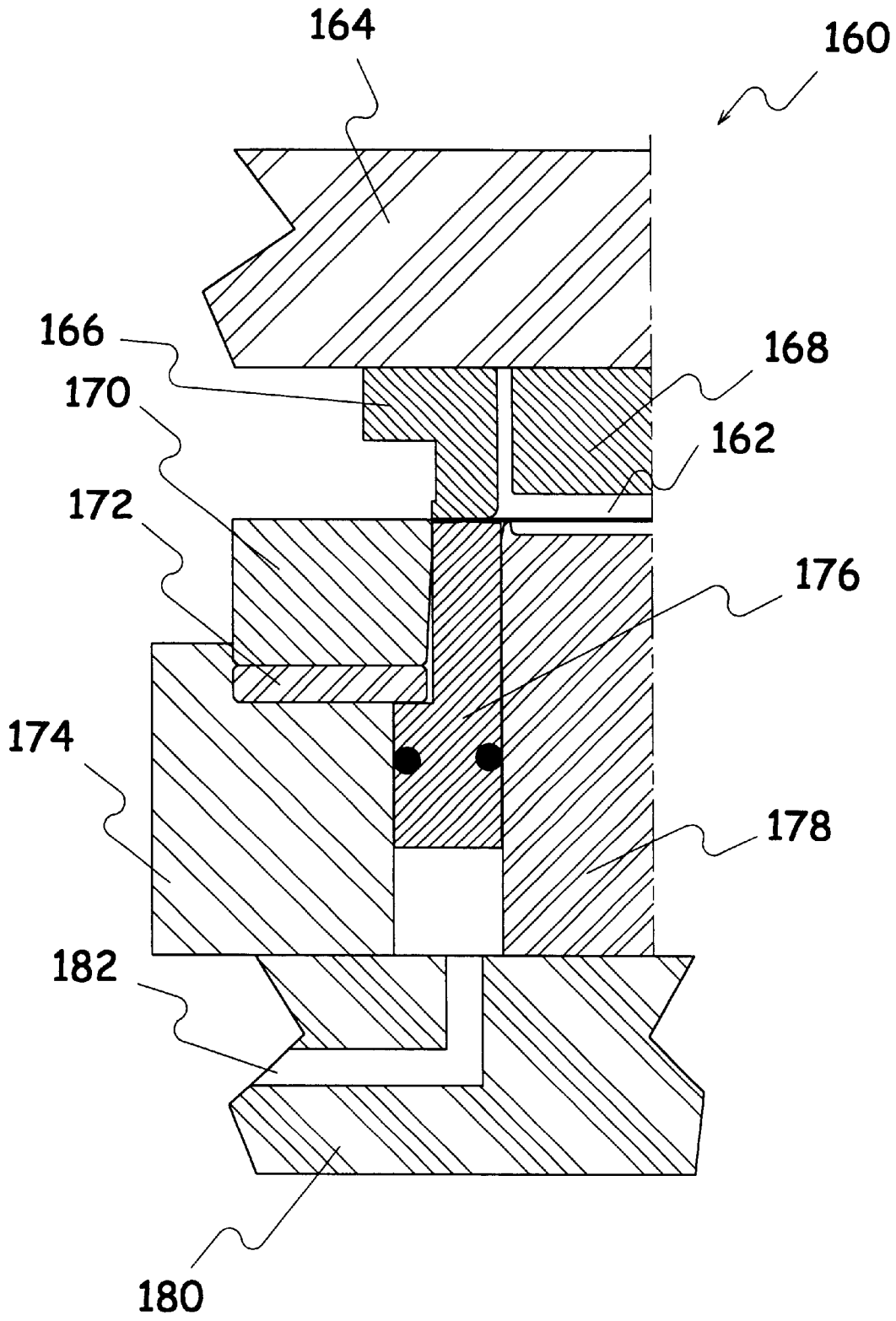

FIG. 26 is a view similar to FIG. 25, showing the tooling of FIG. 25 after blanking a lid disc from sheet stock and prior to further forming.

Figure 27:
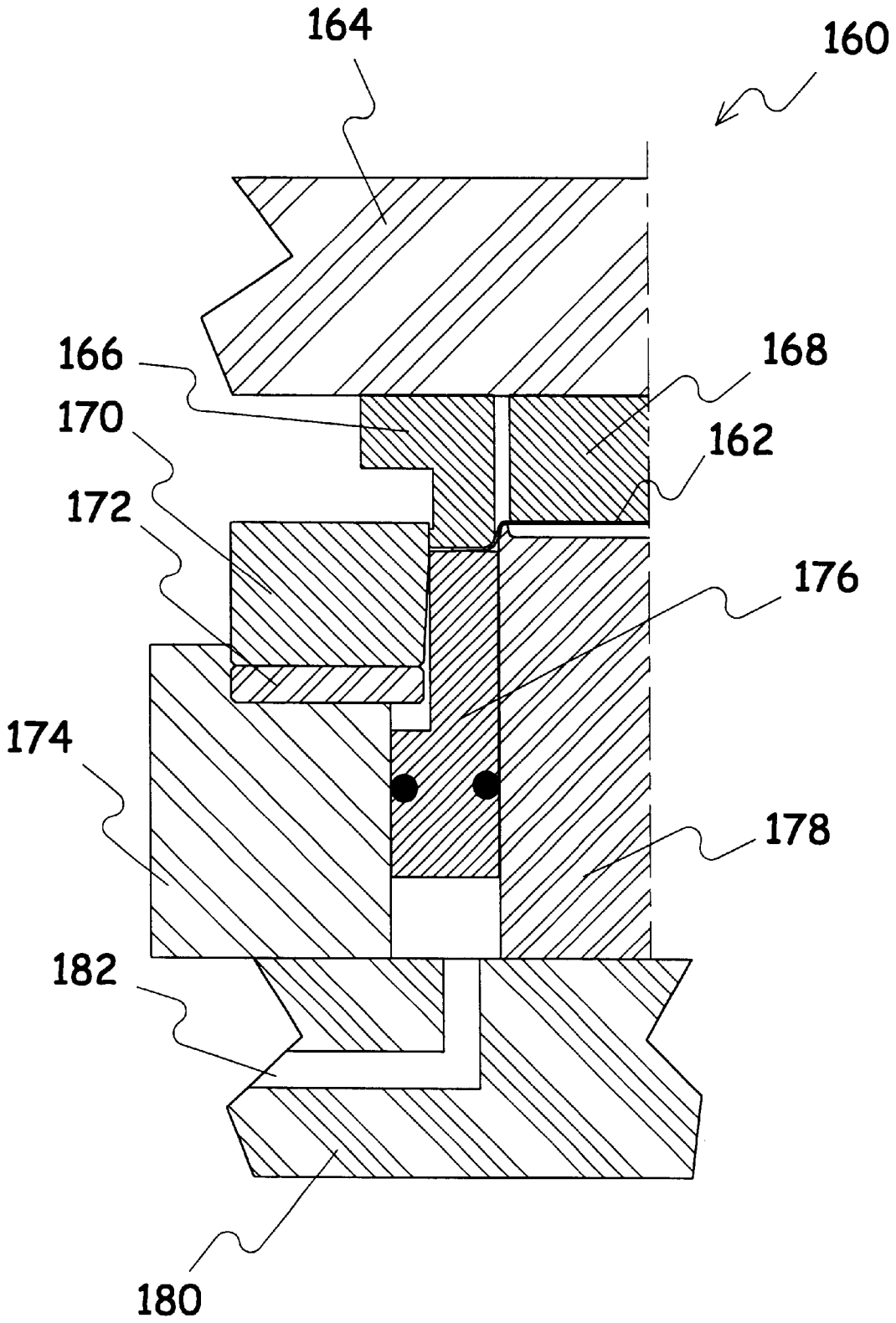

FIG. 27 is a view similar to FIG. 26, showing tooling of FIG. 26 ironing the peripheral lip of the lid disc.

Figure 28:
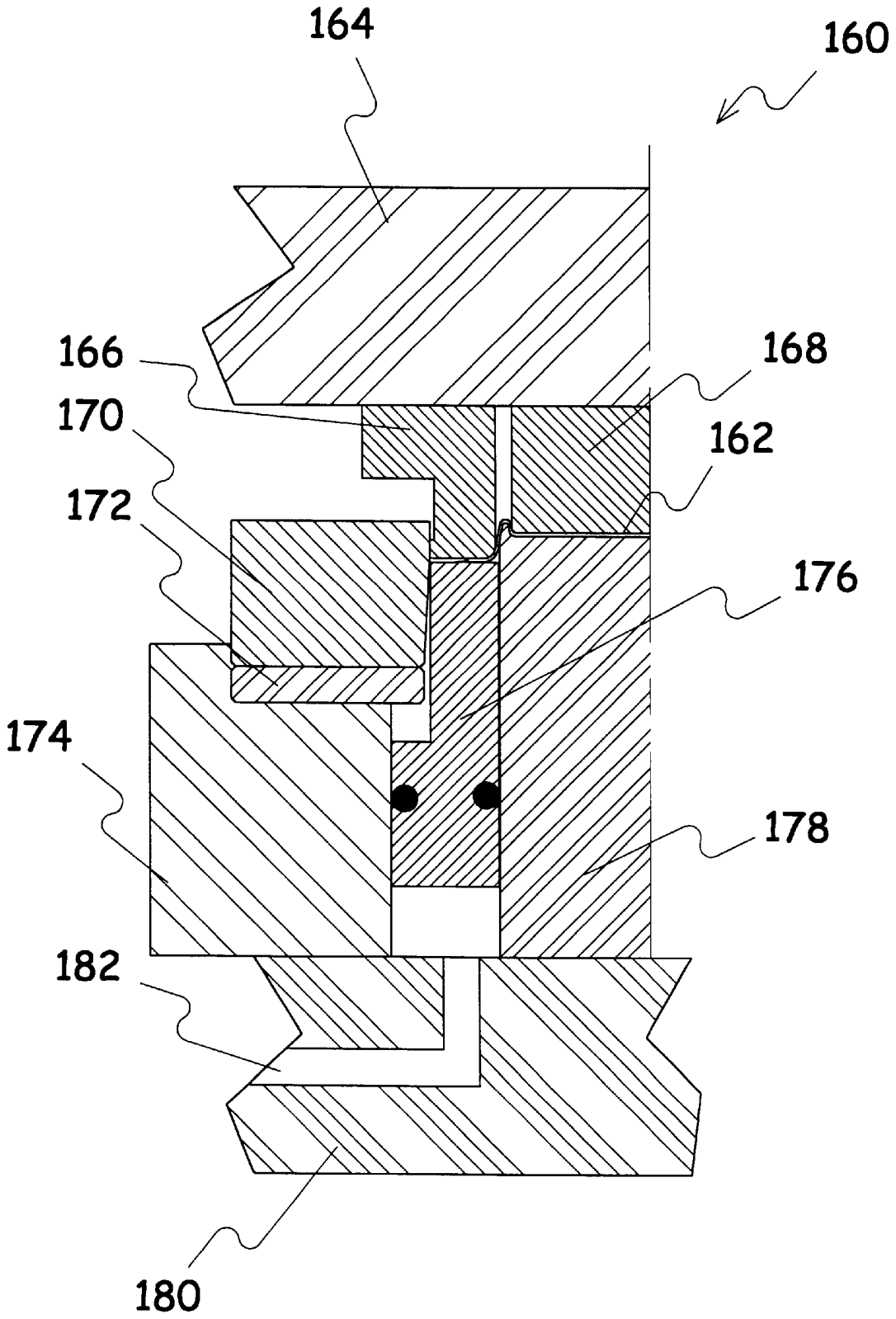

FIG. 28 is a view similar to FIG. 27, showing tooling of FIG. 27 completing the formation of the lid contour.

Figure 29:
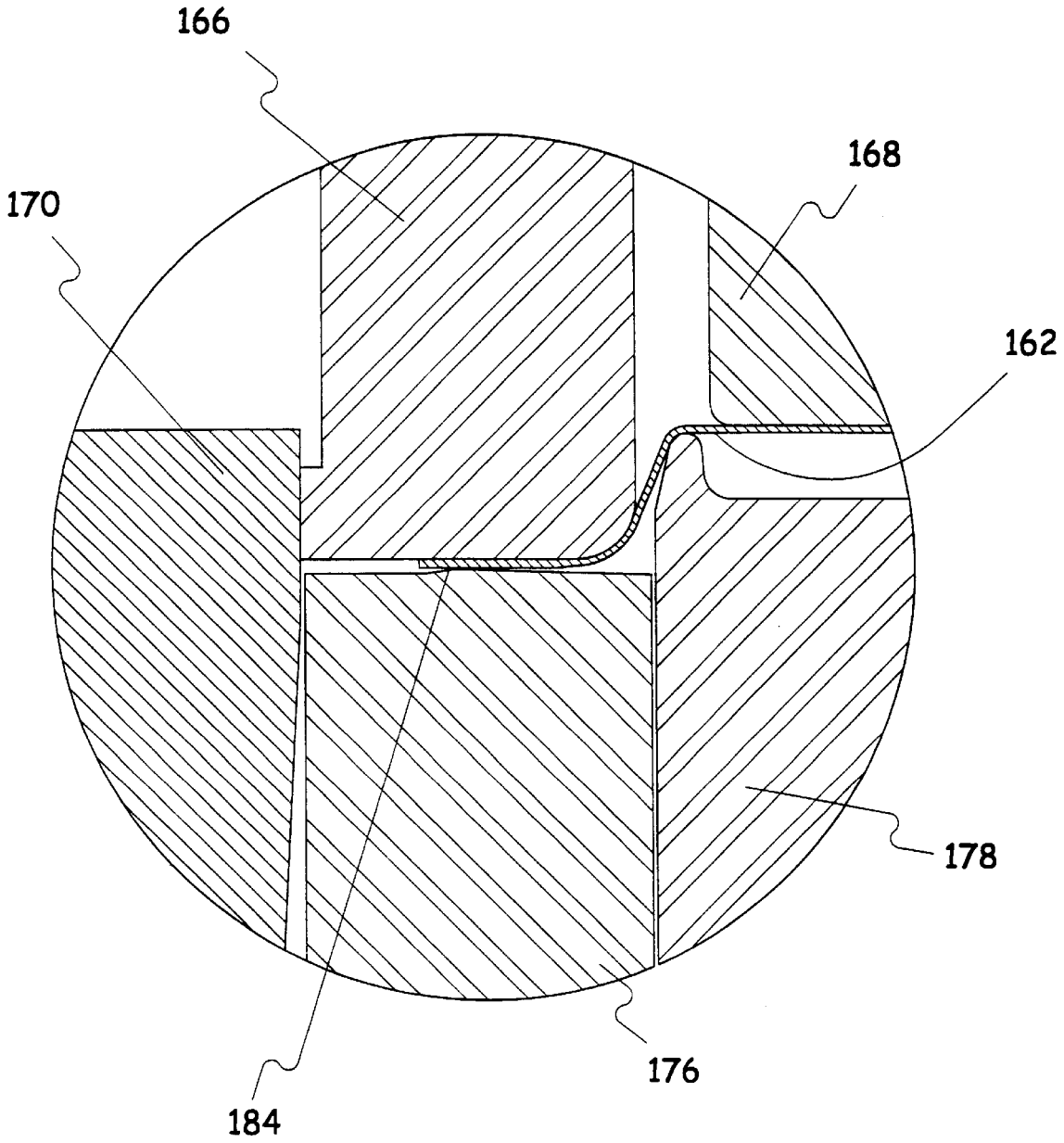

FIG. 29 is an enlarged fragmentary view of the tooling performing the ironing process carried out in FIG. 27.

DETAILED DESCRIPTION OF THE INVENTION

The invention provides a new workpiece structure, method of forming the workpiece structure, and apparatus for forming the workpiece structure. In particular, the workpiece is a container lid, which may be lid of the type used in the canning art to seal food and beverage cans. The lid may be a bottle cap, of the type often called a crown cap, as has been used on beverage bottles for may years. The lid also may be a screw-on jar lid, as used on may food products. While these lids show an approximate scope of the invention, there are still other types of lids, ends, and caps to which this technology can be applied. Therefore, the description of the invention will be given with respect to various specific examples, which are given only as examples and not as limitations.

The new lid is formed and configured to have a thinned peripheral lip that enables a savings of the material needed to form the lid. A great majority of lids are formed from sheet stock of a selected material, often a metal such as aluminum or steel, although various other materials may be useable. The sheet stock is formed to have a specified thickness, which may have certain variations as expected in any product and as known in the trades. When referring to sheet stock, at times it will be mentioned that the sheet stock is of a predetermined thickness. Reference to a generally predetermined thickness merely takes into account the trade practice of offering sheet stock of a certain thickness dimension, with normal variations being accepted within this reference.

Sheet stock is formed into lids by first shearing or punching a blank, typically a disc, from the sheet stock. A blank may be a flat disc. For convenience of reference, portions of the flat disc can be identified according to their relative regions of the disc, without requiring any physical border. For example, relative sub-portions of a blank may be called a central portion and a peripheral annular lip portion merely by assigning such titles to the appropriate areas of the blank identified by the relative positional terms, "center" or "peripheral lip."

Further, sheet stock can be viewed as lying generally in a single plane. In many instances, sheet stock is supplied in spiral wound coils, but the portions of such coils are generally flat when fed on a support table through a cupper, blanking press, or shell press. Similarly, the blank punched from coil stock can be viewed as generally planar or laying generally in a plane, despite possible imperfections in the flatness of the blank. Therefore, reference to generally planar surfaces take into account common variations in the straightness and flatness of articles formed from coil stock.

In a first embodiment, the invention is a container end, such as an aluminum or steel can lid, that is formed from a reduced amount of forming material, especially at the peripheral edge, lip or curl wall. Metal savings can be achieved by apparatus and method of reducing the thickness of material in one or more selected areas, preferably during manufacturing at a single workstation. The thickness of material in a traditional container end typically is the same as or similar to the thickness of a sheet stock from which the end material was taken. Thus, a starting point for measuring metal savings is the predefined thickness of the sheet stock, which commonly is, for example, 0.009-inches. This predefined thickness is selected in order to form a container end that can resist the pressure of a carbonated beverage such as a soft drink or beer.

Figure 1:
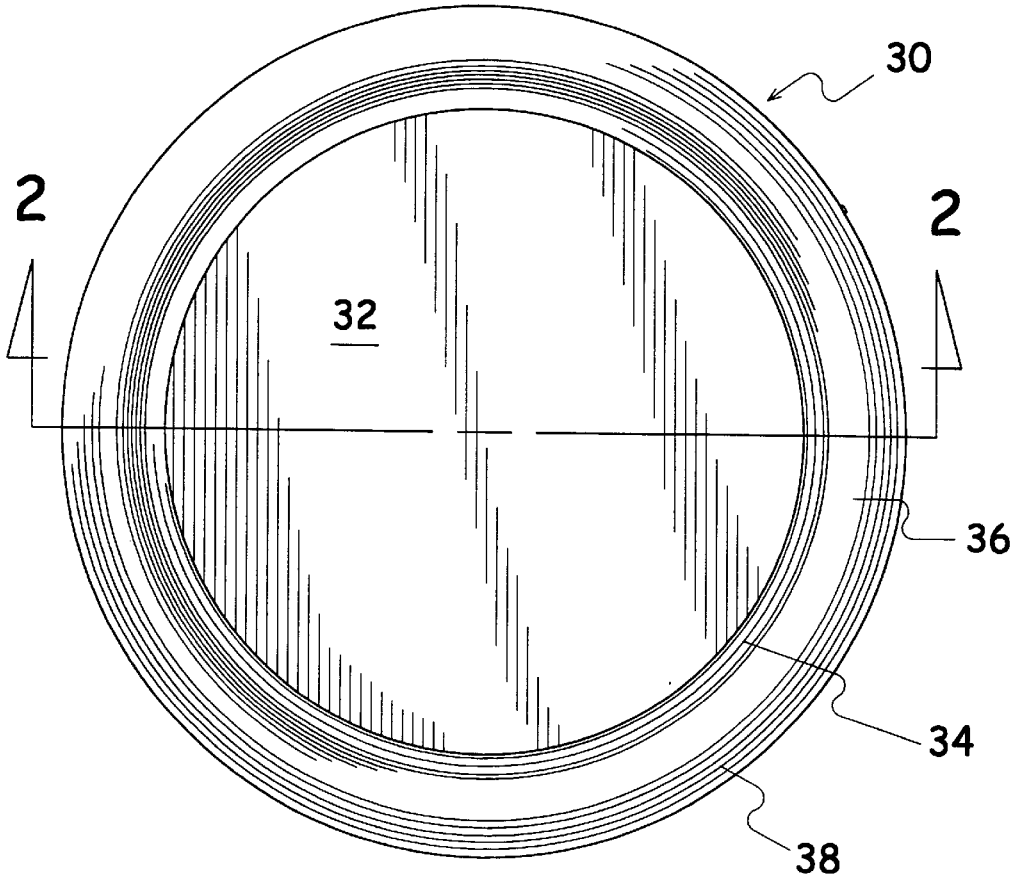
FIG. 1 is a top plan view of a container end made according to the invention.
Figure 2:
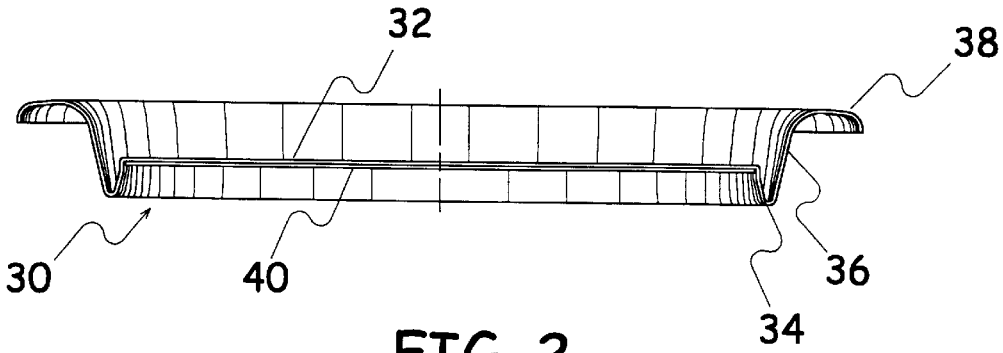
FIG. 2 is a vertical cross-sectional view of a first embodiment of the container end of FIG. 1, taken along the plane of line 2—2 in FIG. 1.

The container end is configured with traditional features, as shown in FIGS. 1 and 2. The first embodiment of the container end will be described primarily with respect to the orientation of FIG. 2, where the container end is positioned as a top lid that will be applied over the open top end of a container body. However, this common orientation and various relative terms such as "upper," "lower," "top," and "bottom" are purely for convenience of description and are not limitations.

The lid 30 is formed of a disc shaped central wall 32, which may be planar, domed, or configured with any variety of ribs, grooves, texture, rivets, opening devices, pour openings, and the like. A concentric annular groove 34, sometimes referred to as the countersink groove, circumferentially surrounds the central wall and extends below the level of the central wall. Such a countersink groove is known to improve the pressure resistance of a lid. At the outer edge of the countersink groove, a concentric annular wall 36 extends to a position above the central wall. Such a wall is known as a frustoconical wall or chuckwall. This wall circumferentially bounds the countersink groove and extends upwardly and outwardly from the central wall. Finally, a concentric annular peripheral lip or curl wall 38 extends peripherally from the top of the frustoconical wall.

Material savings are achieved by any of several techniques. In order to define the material savings, it is useful to note that certain portions of a container lid 30 are of approximately the same thickness as the starting sheet stock from which the lid is formed. These portions are the central wall and countersink groove. Hence, these portions can be identified as having a greater thickness than a predefined minimum dimension. A useful minimum dimension for this definition is a dimension only slightly less than that of traditional lid sheet stock, i.e., slightly less than 0.009-inches. This definition is provided to accommodate the fact that the normal structures of a conventionally structured container end, as identified above, can cause variation in the thickness of the forming material, even when the entire lid is formed from sheet stock of substantially a single thickness. Thus, the traditional formation of the countersink groove 34 and chuckwall 36 may cause a small amount of drawing or compaction of metal in the central wall or other areas of the lid. Nevertheless, there is a minimum dimension almost equal to the stock thickness or slightly less than the stock thickness, for example 0.0085-inches, that will be exceeded by the conventionally formed lid structures of the prior art.

According to the invention, in those areas of the lid where material savings are realized, such as in the peripheral lip or curl wall, the material thickness is less than the predefined minimum dimension of the remaining portions of the lid. In a generalized embodiment, preselected thicker portions of the lid, such as the central wall, can be formed of multiple layers of a material or as a laminate. Although various laminate structures are known, the preferred laminate is formed of at least two sheets of metal held together either by adhesive or by a structural support The peripheral lip or curl wall is formed of at least one less sheet of forming material than are the preselected thicker portions of the lid. In one possible structure that illustrates material savings, the preselected thicker portions of the lid are formed of first and second sheets of a forming material. The curl wall is formed of a peripheral portion of only one of the two sheets of forming material, extending beyond the radius of the other sheet More specifically, the central wall, annular groove, and frustoconical wall each can be formed of a multi-layer structure of at least a first and a second sheet of forming material of dissimilar thickness. The first sheet may have a thickness of less than sixty percent the overall thickness of the multi-layer structure. The curl wall can be formed of a peripheral portion of the first sheet of forming material, resulting in a curl wall at least forty percent thinner than the multi-layer portion of the lid structure.

As shown in FIG. 2, a first embodiment of a container end 30 saves metal by employing starting sheet stock substantially thinner than the traditional dimension of 0.009-inches. The sheet stock in FIG. 2 can be approximately forty to fifty percent less in thickness, with a sheet stock thickness of 0.005-inches, or 45% reduction, being possible while maintaining pressure resistance. In this embodiment, the central wall panel 32 is formed of a double layer of the forming material. The combination of a top wall 32 and a bottom wall 40 produces a central wall panel with overall thickness equal or greater than the thickness of 0.009-inches that is typically required for adequate strength in a lid.

Figure 3:
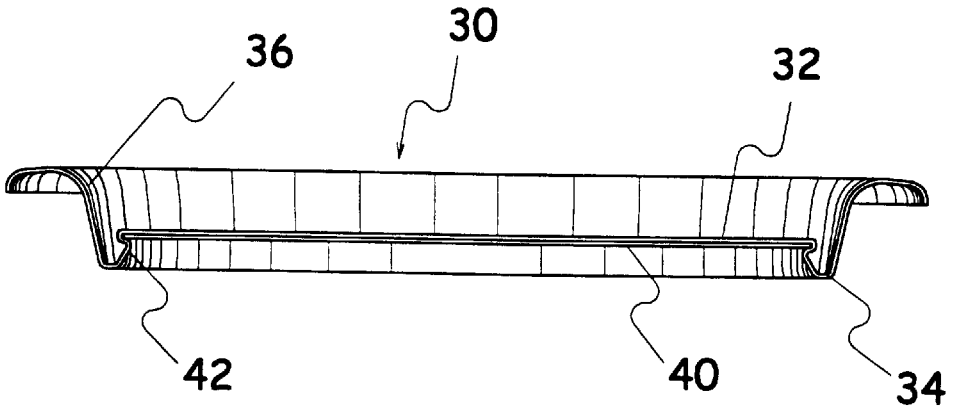
FIG. 3 is a vertical cross-sectional view similar to FIG. 2, of a second embodiment of the container end.

Various techniques can be employed to combine the two layers in a structural and function way. An adhesive or sealant between the layers is effective to produce a laminate structure. Alternatively, FIG. 3 shows a structural method of securing the lower layer 40 to wall 32, by forming a radially inward crimp 42 below the second wall 40 at the circumferential margin of the central wall and countersink groove. In a laminate or multi-layer structure of the forming material, each sheet of forming material may be formed of a metal such as aluminum and steel. The second or bottom wall 40 can be extended beyond the area of the central wall 32. For example, it can be applied across the countersink groove 34 and frustoconical wall 36. The two layers of forming material can be joined at a fold or crimp at the circumferential edge of the central wall 32, or they may be seamed together at the curl wall 38 when the lid is applied to a container body.

The second sheet of material 40 may lie parallel to the first wall 32 through the countersink groove 34 and frustoconical wall 36. The second sheet 40 is preferred to end before the curl wall 38, so that the curl wall is formed of only one layer of material. This use of only a single layer of material results in the curl wall's being effectively of reduced thickness relative to the multi-layer portions of the lid. For example, the curl wall 38 is only about one-half the thickness of the overall wall structures in the countersink groove and frustoconical wall. In addition, the central panel also is of such as reduced thickness. If each layer of material is chosen to be about 0.005-inches, the curl wall would be of about this chosen thickness, while other portions of the lid, selected from the central wall, the countersink groove and the frustoconical wall, would have a thickness of about 0.010-inches. The extent of the second layer 40 can be selected as required. For example, the second layer can be co-extensive with the first layer through the central wall, countersink groove and frustoconical wall, terminating at or near the curl wall. A crimp 42 or other seam can be employed to hold together the two layers of material, regardless of the extent of the second wall.

Figure 4:
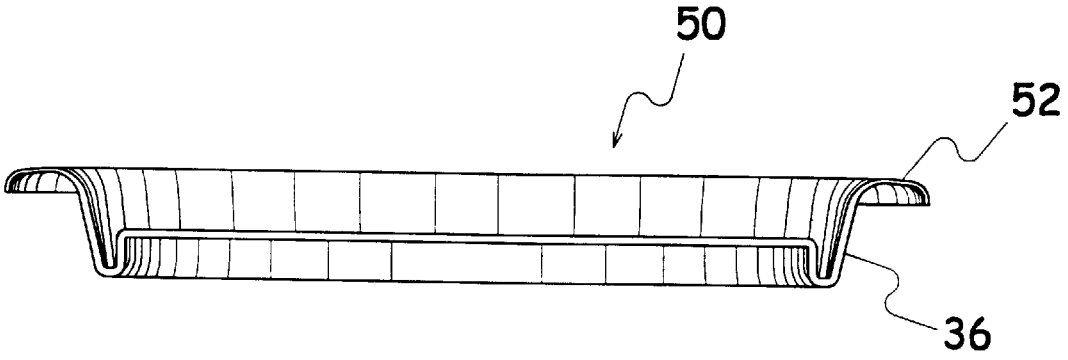
FIG. 4 is a vertical cross-sectional view similar to FIG. 2, of a third embodiment of the container end.

A second embodiment of the invention provides a container end 50, such as shown in FIG. 4, that achieves a reduction in the amount of forming material by modifying the peripheral lip or curl wall 52 through a reforming process. This embodiment employs a starting sheet stock of conventional predetermined thickness, such as 0.009-inches. The container end 50 is formed by a process illustrated in the series of FIGS. 5–15 and described below.

First, starting with planar sheet stock, a conventional shell press shears a disc-shaped blank, which will be of approximately the same predetermined thickness as chosen for the sheet stock. In addition, the blank will be of preselected diameter reflecting the required size of the finished container end. Using conventional forming art, the diameter of the blank is selected to be approximately equal to the length of the forming material as configured in the completed container end. However, as explained below, the invention allows the selection of a reduced blank diameter.

A conventional shell press shears the blank from the sheet stock by using shearing dies. The press also performs a second step of configuring the blank into a shell by using compound forming dies, producing a shaped blank or shell 50 of FIG. 5. The configuration of this shell provides a planar central wall 54 bounded by a concentric annular groove 56 near the outer circumference of the shell, and with a transverse peripheral wall 58 oriented perpendicular to the plane of the central wall 54 and terminating in an outer edge of the shell.

Figure 5:
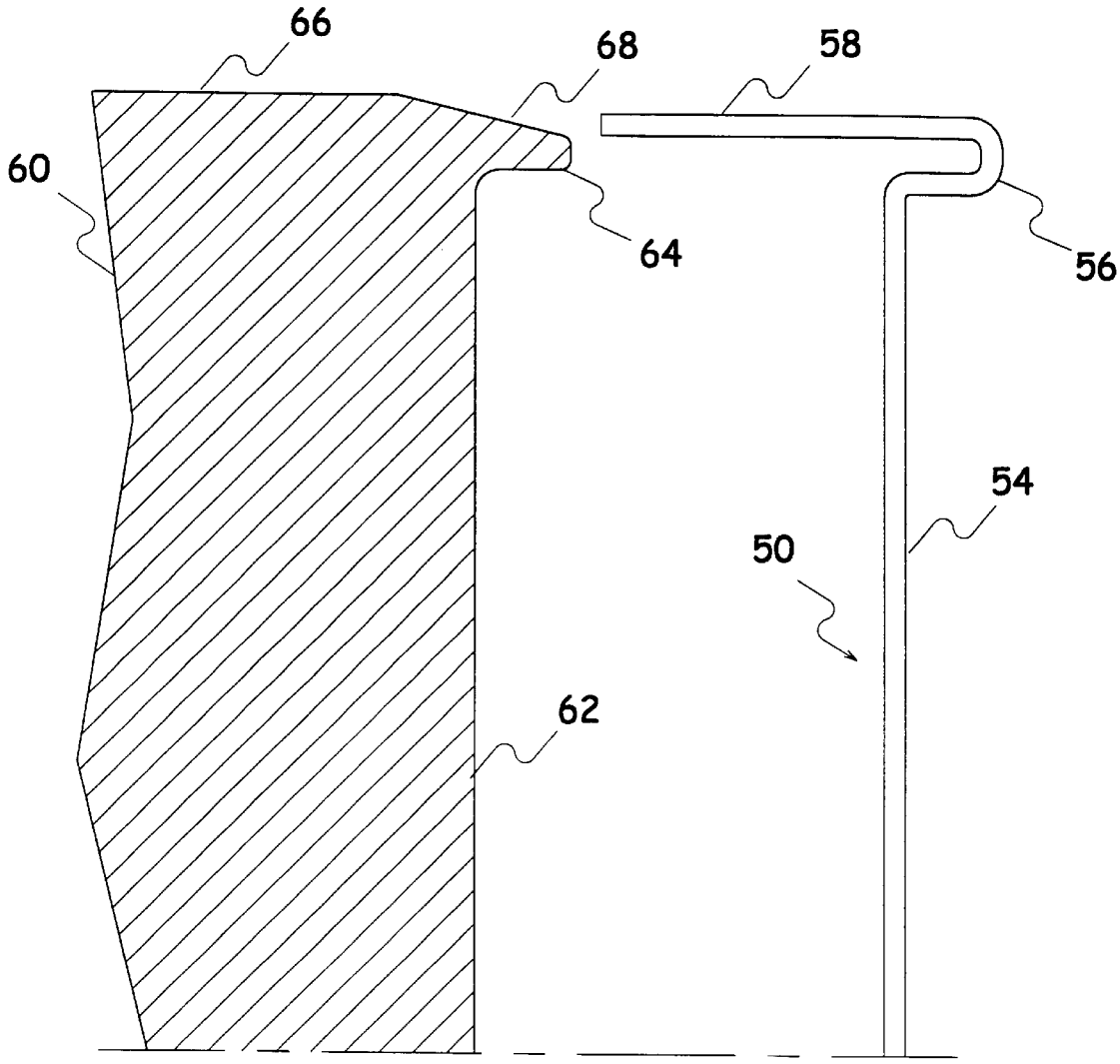
FIG. 5 is an enlarged fragmentary vertical cross-sectional view of a container end configured as fabricated from a shell press and showing a forming punch or mandrel for supporting the container end.

A third step in the forming process applies a punch or forming mandrel 60 to the shell 50. One suitable type of forming mandrel is a punch as shown in FIG. 5, having a flat end surface 62 supporting the central wall 54, a circumferential rib 64 extending longitudinally forwardly from the end of the mandrel and partially supporting the groove 56, and a longitudinally rearwardly extending cylindrical side wall 66 of larger diameter than the peripheral wall 58. The rib 64 is connected to the side wall 66 by an inclined forming wall 68 that reforms the shell by expanding the diameter of the shell wall 58 as the punch enters the shell. As best shown in FIG. 6, the shell is positioned on the forming mandrel with the central wall 54 supported on the end wall 62 of the mandrel, and with the peripheral annular wall 58 positioned along the longitudinal side wall 66 of the mandrel. Inclined wall 68 guides shell wall 58 onto the larger diameter of mandrel wall 66, resulting in the shell being reformed at the junction of peripheral wall 58 and groove 56 to have an inclined shell wall 70 corresponding to inclined mandrel wall 68. With the shell mounted on the mandrel, the mandrel carries the shell through subsequent forming steps.

As shown, for example, in FIG. 7, a thinning means is applied to the peripheral annular wall 58 for thinning the annular wall to a thickness less than the predetermined stock thickness. For this purpose, the mandrel 60 carries the shell 50 through a longitudinal path passing through at least one annular ironing die 72. The die 72 is provided with a working surface 74 spaced from the side wall of the mandrel such that it irons and thins the peripheral shell wall 58, reducing its thickness by, for example, 0.002-inches. Thus, as shown in FIG. 8, a single ironing step may reduce the peripheral wall 58 from an initial thickness of 0.009-inches to a thinner and longer modified peripheral wall 76 having a reduced thickness of 0.007-inches and having a slightly greater length than the unmodified peripheral wall 58. Due to the ironing process, annular wall 76 has a thickness less than the predetermined stock thickness. Also, because ironing increases the length of the peripheral wall 58, another form of material savings is achieved by selecting a smaller diameter for the initial blank, which than is effectively increased when lengthened to form wall 76 through ironing.

The thinning means applied to the shell may include more than one ironing die. As shown in FIG. 9, the forming mandrel 60 may carry shell 50 sequentially through a second ironing die 78 whose working surface is situated relatively more closely to the mandrel. The second ironing step may reduce the thickness of wall 76 by another 0.002-inches, resulting in the peripheral wall having a thickness of 0.005-inches, which is more than 40% less than the preselected thickness of the starting sheet stock. Likewise, the resulting thickness of the peripheral wall is about 40% thinner than the initial thickness of the same peripheral wall. The dimensions mentioned are examples and not limitations; but after thinning, the resulting peripheral wall 76 is reduced to a thickness of about 56% of the predefined minimum dimension if such dimension is taken to be the approximate beginning stock thickness of 0.009-inches.

FIG. 10 shows that the second ironing process has both thinned the peripheral wall 76 and further lengthened it. Thus, two ironing steps enable material saving both in the thickness of the peripheral wall and in the necessary diameter of the starting blank. FIGS. 9 and 11 also show that the inclined wall 70 provides a transitional area between the ironed peripheral wall 76 and the non-ironed groove 56. The portion of the inclined wall 70 immediately juxtaposed to the base of groove 56 remains of approximately the same thickness as the sheet stock, while the portion of the inclined wall immediately juxtaposed to the peripheral wall 76 may be slightly drawn and reduced in thickness. Also significant from the perspective of forming a container end, the ironing process provides a small, uniform lengthening of the peripheral wall 76, such that the end edge 78 of the wall remains sufficiently uniform that trimming is not necessary.

FIG. 11 shows an alternate thinning means that can be applied to the peripheral annular wall 58. A spin forming technique can be used for this purpose. The mandrel 60 receives the cylindrical shell 50 as previously described. The mandrel 60 spins about a central axis 84, with such spinning indicated by the circular arrow 80. One or more forming rolls 82 are advanced radially toward the central axis 84 of the spinning mandrel. Each forming roll is carried on a central shaft on bearings for rotation about a central axis of the shaft, which allows the forming rolls to spin as they contact the peripheral wall of the lid. The forming rolls 82 have an outer surface containing forming ribs 88, which may be arranged in a helical or threaded pattern. The ribs of the forming roll tend to move and thin the material of the peripheral wall as they roll over it. The pressure of the forming rolls and the amount of movement control the degree of thickness reduction.

After the peripheral wall has been thinned by a suitable means, the shell 50 is stripped from the mandrel or punch. The process of thinning the peripheral wall is substantially complete. Thereafter, the shell can further processed by in conventional ways, as desired. Typically, the peripheral annular wall 76 will be formed into a peripheral curl wall 90 to complete the manufacture of a container end having a curl wall of thickness less than the predetermined stock thickness.

A curl wall can be formed by various known techniques, including spin forming and die forming. A curl forming die 92, FIG. 12, is contoured with a central flat surface 94 adapted to support the central wall 54 of the shell. The die contour provides an annular concentric rib 96 that supports the annular concentric groove 56 of the shell. The rib 96 provides an outer guiding surface 96 directing peripheral wall of the lid into an outwardly curved curl cavity 100.

FIGS. 13 and 14 show further details of the curl forming process. The thinned peripheral wall 76 is guided into the curl cavity 100. The curl forming die 92 fully engages shell 50 as peripheral wall 76 is formed into an outwardly curved curl wall 52. At the completion of the curl forming operation, the curl wall 52 is both thinned and lengthened from its original configuration as wall 58. The curl forming die 92 may form a curl wall with a downwardly curved end as shown in FIG. 4 or with the end curled into a hook shape, best shown in FIGS. 14 and 15.

In the finished container end of FIG. 15, the inclined wall 70 is seen to be the equivalent of frustoconical wall 36 of typical lid structure. This wall may be of thickness greater than the predefined minimum dimension at least over an annular portion immediately juxtaposed to the groove 64. Wall 70 also may be of a thickness less than 60% of the predefined minimum dimension at least over an annular portion immediately juxtaposed to the curl wall 52.

Another application of the invention is shown in FIGS. 16–18, in which a thinning means is applied to save metal in the manufacture of crown-style bottle caps. According to conventional methods of such manufacture, a disc shaped blank is cut from sheet metal stock and initially formed into a shell 102 with a planar central wall 104 and circumferentially surrounded by a depending skirt or low, approximately perpendicular, peripheral wall having the approximate thickness as the initial sheet stock. According to the invention, this shell can be supported on a die, punch, or forming mandrel; and the peripheral wall can be thinning by application of a thinning tool. For example, the shell can mounted on a mandrel and moved through one or more ironing dies to modify the shell 102 such that the skirt or peripheral wall 106 is thinned or tapered toward its free edge. Other thinning means such as spin forming, roll forming, or coining can be applied to the peripheral wall in order to form the thinned or tapered wall 106. After the peripheral wall has been thinned, the crown-style cap is completed by forming the thinned wall 106 into a radially extending convoluted wall 108 with the convolutions formed in the thinned portion of the peripheral wall. This cap is applied to a bottle by a conventional capping machine that collapses the convoluted peripheral wall around a lip of a bottle mouth to form a pressure resistant engagement.

In still another embodiment of the invention, lids of the type that engage threaded container ends can be thinned at their skirt or peripheral wall. FIGS. 19–21 show the formation of a lid that includes radially inward extending thread followers and can be applied, for example, to a glass jar. As shown in FIG. 19, this lid is produced by forming a shell 110 having a planar central wall 112 circumferentially surrounded by an approximately perpendicular side wall 114 with a thinned or tapered lip 118. Techniques such as roll forming, spin forming, coining, or ironing can be employed to form the thinned portion of the side wall. Subsequent forming folds the thinned lip 18 radially inwardly as best shown in FIGS. 20 and 21. This lip forms a plurality of thread followers 120 that can be mated with threads on a suitably sized and configured mouth of a jar or like container.

Among additional suitable methods for thinning the lip of a lid or cap are rolling, spinning, coining, and modifications of the ironing methods described above. A circumferential rolling or spinning method is illustrated in FIG. 22, in which a container end 50 is held against a die 122 by a pressure plate 124 while one or more rollers 126 are applied against the peripheral wall 38, both extending and thinning it. The roller 126 and die 122 are moved with respect to each other with relative rotation, such as by spinning the die about its centerline or orbiting the roller. In addition, the roller is moved radially outwardly with respect to the die in order to contact the full peripheral wall and extend it radially outwardly. After completion of the rolling or spinning, the peripheral wall can be additionally shaped and formed in curling dies, as shown in FIGS. 12–14.

A coining method of thinning the lip is shown in FIGS. 23 and 24. FIG. 23 shows a lid shell 128 being formed from sheet stock 130 in a shell forming machine. The sheet stock 130 is placed on a support table 132, where a multi-die punch forms the shell. A cutting die set 134, 136 moves transversely to the support table 132, severing a blank from the sheet stock at the interface of the support table and die set. A central drawing die 138 pushes the center of the blank against an opposing yieldable pressure plate 140. The central die 138 is configured with a longitudinally extending rib at the circumference of its face, extending into a gap at the side of the pressure plate 140. The die 138 and pressure plate 140 form a central wall structure 142, while the rib enters the gap to form the annular groove 144. The lower cutting die 136 supports the peripheral wall of the lid at a first planar level while the die 138 moves the central portion of the lid to a second, lower planar position, forming a frustoconical wall 146 between the groove 144 and peripheral wall 148. As shown in FIG. 23, the peripheral wall 148 of the blank is supported between dies 134 and 136. The clamping force exerted by the dies allows the wall 148 to be drawn between the dies and toward the center of the blank as the frustoconical wall 146 is formed. The resulting shell structure differs from FIG. 5 by initial formation of a radially extending peripheral wall 148.

In FIG. 24, a curl wall is formed by a coining method. The peripheral wall 148 of the shell is positioned between upper and lower annular coining dies 150, 152, which come converge on opposite faces of the peripheral wall 148 to thin the wall. The coining process also radially extends the peripheral wall while forming the curl. The central wall 142 and annular groove 144 are supported between a central die set 154, 158, while the frustoconical wall 146 us supported by the contour of the lower coining die 152. The resulting lid is similar in configuration to lid 40 of FIG. 4.

Numerous methods and apparatus for thinning the peripheral wall of a lid, bottle cap, or container end have been shown. The preferred method and apparatus will be described in conjunction with FIGS. 25–29. This method and apparatus employs modified tooling of a type that might be substituted into a blanking press, so that the resulting method can be practiced within an existing can line. Alternatively, a blanking press that employs the illustrated tooling can be produced in a size that readily replaces existing blanking presses.

An apparatus or tooling set 160 is arranged in a blanking press or other shell forming machine. The tooling can be viewed as having both upper and lower components, relative to flat sheet stock 162 received between the upper and lower dies in a conventional manner. A typical blanking press includes a plurality of tooling sets 160 that sever a like plurality of lids with each cycle of the press. In a typical blanking press, the sheet stock 162 is fed or advanced across a support table as previously shown and described. FIG. 25 shows only one such tooling set 160. An upper die shoe 164 is mounted above both the support table and the sheet stock for initial movement toward the sheet stock. Such movement is perpendicular to the plane of the sheet stock and may be movement in a vertically downward direction according to the orientation of FIG. 25. The upper die shoe carries a ring shaped blanking punch 166 that defines the initial diameter of the blank to be cut. A cutting edge is located on the radially outer face of the punch. The upper die shoe carries a countersink punch 168 of slightly smaller radius than the ring of the blanking punch. Countersink punch 168 is spaced radially inwardly from the blanking punch, and thereby defining an annular gap between the blanking punch and the countersink punch. The gap opens toward the underlying sheet stock.

The tooling set provides further elements that initially are below the plane of the support table and sheet stock 162. An annular blanking die 170 cooperates with the blanking punch 166 to cut a blank of the desired size. A cutting edge is located on the radially inner edge of the blanking die 170. Thus, a central area or central opening within the inside radius of the blanking die 170 is of the approximate diameter of the desired blank. The blanking punch 166 is sized, in part, to closely fit through the central opening of the blanking die 170 during the blanking process. A grind spacer 172 supports the blanking die at the desired height above an underlying lower die holder 174.

An annular clamping and ironing ring 176 is carried radially inside the blanking die 170 and is positioned generally in longitudinal opposition to the blanking punch 166. The clamping and ironing ring 176 is carried radially inside the lower die holder 174 and radially outside a countersink forming die 178. The countersink forming die 178 is approximately longitudinally opposed by the countersink punch 168. Die 178 is configured to have a raised rib or shoulder that is sized to enter the gap between the countersink punch 168 and the blanking punch 166. The raised shoulder serves as a circumferential wall at the outer margin of a central recess or cavity of the countersink forming die 178. Both the lower die holder 174 and the countersink forming die 178 are carried on a lower die shoe 180. A passage or plenum 182 in the lower die shoe communicates with the lower face of the clamping and ironing ring 176, enabling a preselected air pressure to be supplied through the plenum to yieldably support the clamping and ironing ring 176 against being displaced by the blanking punch 166. Suitable seals, such as o-rings, between the ironing ring and its neighboring structures 174, 178 prevent loss of pressure through the tooling components. Thus, the ironing ring 176 is moveable against air pressure when pushed by the blanking punch 166. Air pressure supplies a variably selected clamping or opposing force. The clamping and ironing ring 176 and the blanking punch 166 are clamping elements for engaging the peripheral lip portion of the blank during forming operations.

The invention includes a method of forming a blank and shaping it into a lid with a thinned peripheral lip portion. The product of the method may resemble the lid shown in FIG. 4, either with or without a curl formed in the peripheral wall. FIG. 25 shows a representative starting position for the tooling components, from which the upper die shoe 164 and lower die shoe 180 move relatively toward one another. The plane of the sheet stock defines a point of reference, from which the upper die shoe can be viewed as moving downwardly toward the sheet stock 162. The blanking punch 166 moves into contact the sheet stock 162 as shown in FIG. 26. Punch 166 and die 170 cooperate in shearing a circular blank out of the sheet stock. With continued downward movement of the upper die shoe as shown in FIG. 27, the lower face of punch 166 moves below the plane of the sheet stock, clamping the peripheral lip of the circular blank against clamping and ironing ring 176.

Thereafter, the leading face of blanking punch 166 advances further below the plane of the sheet stock. This continued motion overcomes the force of air pressure supporting the clamping and ironing ring 176. Ring 176 and the clamped peripheral lip of the blank move downwardly with the advancing punch 166. The continued downward movement forces the clamping and ironing ring 176 to move below the plane of the sheet stock. As best shown in FIG. 27, the center of the blank comes into contact with the countersink forming die 178, initially at the upstanding shoulder of the die, and initially is supported at the level of the shoulder. As the blank 162 and the die 178 are caused to move in relatively opposite directions, the peripheral wall of the blank is moved below the face of the die 178, deforming the material of the blank between the central area of the blank and the peripheral wall of the blank into a frustoconical wall of the lid as previously described. Within the tooling, the frustoconical wall is formed between the shoulder portion of the die 178 and the radially inner face of punch 166.

The lower face of the countersink punch 168 is in a plane offset upwardly from the lower or leading face of the blanking punch 166. This offset permits the punch 166 to bring the peripheral wall of the blank below the plane of the sheet stock before the countersink punch 168 contacts the central portion of the blank. Subsequently, the upper die shoe 164 and its carried punch 166 and countersink punch 168 moves further downwardly, bringing the face of the countersink punch 168 into the center recess or cavity of die 178.

By suitable selection of air pressure applied against the clamping and ironing ring 176, the process of initially forming the frustoconical wall causes the peripheral wall of the circular blank to be drawn radially inwardly through the cooperating clamping surfaces of the blanking punch 166 and the clamping and ironing ring 176. Suitable air pressures are readily determined by empirical testing. Inward movement of the blank through the clamping elements is shown in FIG. 27 and in greater detail in FIG. 29. The clamping and ironing ring 176 carries a thinning tool for reducing the thickness of the peripheral wall by movement between the peripheral wall and the tool. The preferred tool is an ironing land 184 carried on a surface or ring 176 contacting the clamped peripheral lip of the blank. Thus, as shown in FIG. 29, the peripheral lip portion of the blank is drawn between the clamping surfaces and over the ironing land 184, which thins or reduces the thickness of the peripheral lip from the original thickness of the sheet stock. The amount of reduction in thickness is controlled by the preselected air pressure applied through plenum 182 to the opposite side of the clamping and ironing ring from ironing land 184.

When the countersink punch 168 enters the central cavity of the countersink forming die 178, it deforms the central area of the blank into central cavity of the countersink forming die 178. This final downward movement of the upper die shoe produces a lid having a configuration similar to FIG. 4. A countersink groove is formed over the upstanding shoulder of the die 178; a central planar wall is formed over the central portion of the die 178; the previously formed frustoconical wall is further extended; and the peripheral lip is radially extended and thinned, although not yet formed into a curl. Such additional forming of the lid draws an additional length of the peripheral lip over the forming land on the clamping and ironing ring 176.

At the completion of downward movement, the upper die shoe and its carried tooling components are raised, returning to the relative position of FIG. 25, and opening the die set Upon opening the die set, the blanking punch is lifted from its position against the clamping and ironing ring, which allows air pressure to raise the ring 176 to its initial position approximately level with the support table. As the ring rises, it acts as a stripper for the formed lid, raising the formed lid from the lower dies for discharge. After discharge, each lid can be further processed as required, such as to form a curl in the thinned peripheral lip.

Similar or equivalent tooling can be used in substantially the same methods to form other types of lids. For example, the shells of FIGS. 16 and 19 can be formed with thinned peripheral walls or skirts by blanking a disc from sheet stock, and with the same die set, supporting a central area of the disc in one relative plane while moving the peripheral area of the disc to another relative plane, causing the peripheral area to be drawn through an ironing die. In turn, by a suitable selection of die shape and location of the ironing die, the peripheral area can be drawn into a substantially perpendicular side wall or skirt. Thus, the method illustrated and described in connection with FIGS. 25–29 is adaptable, mutatis mutandis, to the production of end walls for food and beverage cans, caps for beverage bottles, lids for jars, and the like, all with the peripheral wall or skirt reduced in material thickness from the thickness of the starting sheet stock. While there are many forming techniques suitable for reducing the thickness of peripheral walls, the method of FIGS. 25–29 provides a technique and apparatus that is highly adaptable to existing can lines.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. A method of forming a container lid with a thinned peripheral lip, comprising the steps of:

first, performing a blanking step by shearing a blank from planar sheet stock of generally predetermined stock thickness, wherein the blank is composed of at least a central portion and a peripheral annular lip portion circumferentially bounding the central portion and lying generally in a plane;

second, performing a clamping step by clamping the peripheral annular lip portion between first and second clamping elements, one against each face of the blank, wherein at least the first clamping element carries a thinning means for thinning the peripheral lip portion by relative movement between the thinning means and peripheral lip portion;

third, performing a thinning step by oppositely relatively displacing the central portion of the blank and the peripheral lip portion, transversely to the plane of the peripheral lip, while applying through the clamping elements a predetermined clamping force of a magnitude allowing relative movement between the peripheral lip portion and the thinning means with resultant thinning of the lip portion to less than said generally predetermined stock thickness.

2. The method of claim 1, wherein said thinning means comprises an ironing land carried on a surface of the first clamping element, contacting the peripheral lip portion, and opposed by said second clamping element.

3. The method of claim 2, wherein said thinning step comprises an ironing step wherein the predetermined clamping force is of a magnitude allowing the peripheral lip portion to be moved with respect to said first and second clamping elements and thinned by being drawn over the ironing land.

4. The method of claim 1, wherein:

said thinning means comprises an ironing land carried on a surface of the first clamping element, contacting the peripheral lip portion, and opposed by said second clamping element;

said third step comprises an ironing step wherein the predetermined clamping force is of a magnitude allowing the peripheral lip to be drawn over the ironing land and thereby thinned; wherein the method further comprises:

before said third step, performing a supporting step by applying a supporting means against said central portion of the blank for supporting the central portion against unified movement with the clamping elements in a direction transverse to the plane of the peripheral lip portion; and performing said third step by moving the clamping elements to offset the peripheral lip portion from the central portion of the blank in a direction transverse to the plane of the peripheral lip portion, forming an annular wall between an outer margin of the central portion of the blank and an inner margin of the peripheral lip portion of the blank, wherein the annular wall extends transversely to the central portion of the blank.

5. The method of claim 4, wherein said supporting means comprises a center forming die configured with a central cavity bounded by a peripheral shoulder that first contacts the central portion of the blank in said supporting step;

and further comprising:

fourth, performing a countersink forming step by applying a countersink element, sized to fit into the central cavity of the center forming die, against the central portion of the blank on the side opposite from the center forming die;

fifth, performing a central wall forming step by forming the blank over the peripheral shoulder of the center forming die by moving the countersink element at least partially into the central cavity;

simultaneously performing a further ironing step by further drawing the peripheral lip over the ironing land, and simultaneously forming an annular groove into the blank at a location spaced from the sheared edge of the blank;

thereby defining a container lid having a disc-shaped planar central wall circumferentially bounded by a concentric annular groove, in turn circumferentially bounded by a concentric annular wall positioned transversely to said planar central wall.

6. The method of claim 5, further comprising:

sixth, performing a releasing step by separating the first and second clamping elements.

7. The method of claim 6, further comprising:

seventh, performing a stripping step by moving one of the clamping elements to push the container lid free of the center forming die.

8. An apparatus for forming a container lid with a thinned peripheral lip portion from a disc-shaped blank of preselected diameter, having a central portion and an annular, generally planar, peripheral lip portion, formed of a generally predetermined stock thickness, comprising:

a pair of opposed first and second annular clamping elements sized to engage the blank at the annular peripheral lip portion thereof;

a thinning means carried by at least the first of said clamping elements, for thinning the peripheral lip portion of the blank by relative movement between the thinning means and the peripheral lip portion;

force selection means for applying a preselected clamping force between the clamping elements in a degree permitting the peripheral lip portion to be drawn between the clamping elements in response to opposite relative movement between the central portion of the blank and the peripheral lip portion, transverse to the plane of the peripheral lip portion;

displacing means for oppositely relatively moving the central portion of the blank and the peripheral lip portion, transversely to the plane of the peripheral lip portion, thinning the peripheral lip portion by relative movement between the thinning means and the peripheral lip portion.

9. The apparatus of claim 8, wherein said thinning means comprises an ironing land.

* * * * *